US009089034B2

(12) United States Patent
Yamamoto et al.

(10) Patent No.: US 9,089,034 B2
(45) Date of Patent: Jul. 21, 2015

(54) LIGHTING DEVICE AND LUMINAIRE INCLUDING THE SAME

(71) Applicant: Panasonic Corporation, Osaka (JP)

(72) Inventors: Masafumi Yamamoto, Hyogo (JP); Satoru Nagata, Hyogo (JP); Masato Himeda, Hyogo (JP); Hisaya Takikita, Osaka (JP); Koki Matsui, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/093,704

(22) Filed: Dec. 2, 2013

(65) Prior Publication Data

US 2014/0152182 A1 Jun. 5, 2014

(30) Foreign Application Priority Data

Dec. 4, 2012 (JP) ..... 2012-265683

(51) Int. Cl.
*H05B 37/00* (2006.01)
*H05B 33/08* (2006.01)

(52) U.S. Cl.
CPC ..... *H05B 33/089* (2013.01); *H05B 33/0815* (2013.01); *H05B 33/0887* (2013.01)

(58) Field of Classification Search
CPC ..... H05B 33/0815; H05B 33/0848; H05B 33/0851; H05B 33/0887; H05B 33/0842; H05B 33/0824; H05B 37/02; H05B 41/2985; Y02B 20/346; Y02B 70/1433
USPC ..... 315/122, 187, 192, 291, 297, 224, 287, 315/308, 312
See application file for complete search history.

(56) References Cited

U.S. PATENT DOCUMENTS

| | | | | |
|---|---|---|---|---|
| 6,710,582 | B2 * | 3/2004 | Watanabe | 323/222 |
| 6,997,591 | B2 * | 2/2006 | Krumholz | 362/543 |
| 7,202,641 | B2 * | 4/2007 | Claessens et al. | 323/222 |
| 8,193,727 | B2 * | 6/2012 | Hamana et al. | 315/291 |
| 8,853,949 | B2 * | 10/2014 | Hamamoto et al. | 315/125 |

(Continued)

FOREIGN PATENT DOCUMENTS

| | | | |
|---|---|---|---|
| EP | 2053454 | A2 | 4/2009 |
| EP | 2473003 | A2 | 7/2012 |
| JP | 2010-55824 | A | 3/2010 |

OTHER PUBLICATIONS

Extended European Search Report for corresponding European Application No. 13195413.3 dated Apr. 15, 2014.

*Primary Examiner* — Vibol Tan
(74) *Attorney, Agent, or Firm* — Renner, Otto, Boisselle & Sklar, LLP.

(57) ABSTRACT

A lighting device (10) includes a voltage converter (2) for generating a predetermined DC voltage, a detector (4) for obtaining a detection voltage corresponding to a predetermined DC voltage applied across a light source (20), a controller (3) for controlling the voltage converter (2) so that a current flowing through the light source (20) is constant, and a determination unit (5) for determining whether the detection voltage is a preset first reference voltage or higher. The first reference voltage is set higher by a specified voltage than the detection voltage, and is set to vary more slowly than the detection voltage. The controller (3) stops an operation of the voltage converter (2) when the detection voltage is determined to be the first reference voltage or higher through the determination unit (5).

20 Claims, 13 Drawing Sheets

(56) References Cited

U.S. PATENT DOCUMENTS

| | | | | |
|---|---|---|---|---|
| 8,878,445 | B2 * | 11/2014 | Takata et al. | 315/192 |
| 2009/0102399 | A1 | 4/2009 | Kita | |
| 2011/0080110 | A1 * | 4/2011 | Nuhfer et al. | 315/291 |
| 2012/0161649 | A1 | 6/2012 | Hamamoto et al. | |
| 2012/0262070 | A1 | 10/2012 | Oshima | |

* cited by examiner

10
CN1
CN2
CN11
CN12
CN21
CN22
20
20U
21
If
Vout
R1
R2
R3
R4
R5
R6
R7
R8
R9
R10
R11
C1
C2
L1
L2
Q1
D1
E1
Vref
VA
VS
CP1
1
2
2A
2B
2C
2D
3
4
5
6
7
8
12

LIGHTING DEVICE AND LUMINAIRE INCLUDING THE SAME

TECHNICAL FIELD

The present invention relates to a lighting device and a luminaire including the lighting device.

BACKGROUND ART

Conventionally, there is proposed a light emitting diode (LED) driving device for driving an LED unit where a plurality of LEDs are connected in series (for example, JP 2010-55824 A (hereinafter referred to as "Document 1")).

The LED driving device of Document 1 includes a connecting means, a DC(direct-current)-to-DC converting means, a discharging means, and an ON-OFF switching means. The connecting means is detachably connected to the LED unit. The DC-to-DC converting means includes a smoothing capacitor, and is configured to convert the DC power supplied from a DC power supply. The discharging means includes a switching element, and is configured to form a discharge path for discharging the smoothing capacitor. The ON-OFF switching means is configured to switch between ON and OFF of the switching element of the discharging means.

In the LED driving device of Document 1, when the LED unit becomes detached from the connecting means, the ON-OFF switching means switches the switching element of the discharging means from an OFF state to an ON state. When the switching element of the discharging means is switched from the OFF state to the ON state, the smoothing capacitor of the DC-to-DC converting means is discharged. Thus, in the LED driving device, when the LED unit becomes detached from the connecting means, an output voltage of the DC-to-DC converting means can be decreased. This decrease can therefore prevent the phenomenon where an overcurrent flows through the LED unit when the LED unit is connected again.

In the LED driving device, however, when a second LED unit having a rated voltage relatively lower than that of a first LED unit is connected again, an overcurrent can flow through the second LED unit. In other words, the LED driving device further includes a controlling means. The controlling means is configured to stop the DC-to-DC converting means when the LED unit becomes detached from the connecting means and then the output voltage of the DC-to-DC converting means increases to a preset upper-limit threshold voltage. The upper-limit threshold voltage is set higher than a rated voltage of the LED unit in a steady state. Therefore, in the case where the second LED unit having a rated voltage relatively lower than that of the first LED unit is lit, when the second LED unit becomes detached from the connecting means, a long time is required until the switching element of the discharging means changes from an OFF state to an ON state. As a result, an overcurrent can flow through the second LED unit.

SUMMARY OF INVENTION

The present invention addresses the above-mentioned problems. It is an object of the present invention to provide a lighting device capable of inhibiting an overcurrent from flowing through a light source, and a luminaire including the lighting device.

The present invention provides a lighting device (10) configured to be detachably attached with a light source (20) comprising an LED device (21) as a lighting object. The lighting device (10) includes a voltage converter (2), a detector (4), a controller (3), and a determination unit (5). The voltage converter (2) is configured to convert a DC voltage supplied from a DC power supply (1) into a predetermined DC voltage ($V_{out}$). The detector (4) is configured to detect the predetermined DC voltage ($V_{out}$) applied across the light source (20) to generate a detection voltage ($V_A$). The controller (3) is configured to control the voltage converter (2) so that a current ($I_f$) flowing through the light source (20) is constant. The determination unit (5) is configured to determine whether the detection voltage ($V_A$) by the detector (4) is a preset first reference voltage ($V_S$) or higher. The first reference voltage ($V_S$) is set higher by a specified voltage ($V_m$) than the detection voltage ($V_A$) by the detector (4), and is set to vary more slowly than the detection voltage ($V_A$). The controller (3) is configured to stop an operation of the voltage converter (2) when the detection voltage ($V_A$) by the detector (4) is determined to be the first reference voltage ($V_S$) or higher through the determination unit (5).

In an embodiment, the light source (20) includes a plurality of different LED devices (21) having different rated voltages.

In an embodiment, the light source (20) includes at least two LED units (20U) connected in series. Each of the LED units includes a plurality of LED devices (21) connected in series or parallel. The at least two LED units (20U) are connected in series.

In an embodiment, the first reference voltage ($V_S$) is set to be higher than the detection voltage ($V_A$) obtained from the predetermined DC voltage ($V_{out}$) in at least a specified period (T1) after a time (t1) when the predetermined DC voltage ($V_{out}$) is output from the voltage converter (2).

In an embodiment, a second reference voltage ($V_R$), which is a fixed voltage higher than the detection voltage ($V_A$) obtained from the predetermined DC voltage ($V_{out}$), is previously set in the determination unit (5). The determination unit (5) is configured to determine whether the detection voltage ($V_A$) by the detector (4) is the second reference voltage ($V_R$) or higher. The controller (3) is configured to stop an operation of the voltage converter (2) when the detection voltage ($V_A$) by the detector (4) is determined to be the second reference voltage ($V_R$) or higher through the determination unit (5).

A luminaire of the present invention comprises the light source (20) and the lighting device (10).

In the lighting device of the present invention, it is possible to inhibit an overcurrent from flowing through the light source.

In the luminaire of the present invention, it is possible to provide a luminaire comprising a lighting device capable of inhibiting an overcurrent from flowing through the light source.

BRIEF DESCRIPTION OF DRAWINGS

Preferred embodiments of the invention will now be described in further details. Other features and advantages of the present invention will become better understood with regard to the following detailed description and accompanying drawings where.

DESCRIPTION OF EMBODIMENTS

Embodiment 1

A lighting device of the embodiment is described with reference to FIGS. 1A-1D and 2.

The lighting device 10 of the present embodiment is configured to light a light source 20 including an LED device ("21" of FIG. 6), for example.

Figures 1A, 1B, 1C, 1D:
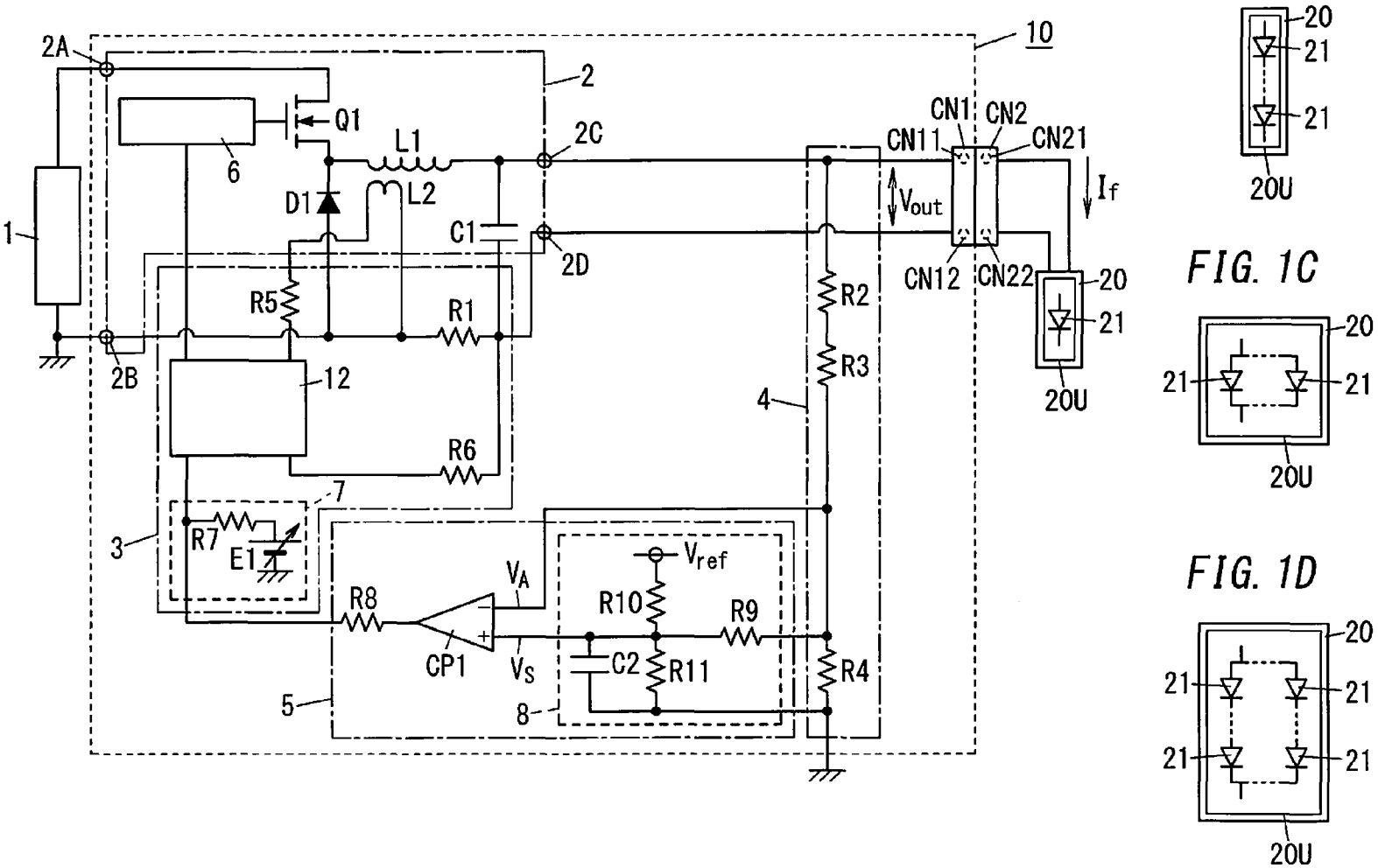
FIG. 1A is a schematic circuit diagram of a lighting device of embodiment 1, and each of FIGS. 1B to 1D illustrates an example of a light source shown in FIG. 1.

The light source 20 may include a plurality of LED devices 21. In the embodiment of FIG. 1B, the plurality of LED devices 21 is connected in series. The connection of the plurality of LED devices 21 may be a parallel connection as shown in the embodiment of FIG. 1C, or may be a combination of series and parallel connections as shown in the embodiment of FIG. 1D. In the embodiments of FIGS. 1B-1D, the light source 20 includes the plurality of LED devices 21, but, as shown in the embodiment of FIG. 1A, the light source 20 may include one LED device 21, as another example.

The lighting device 10 includes a voltage converter 2, a detector 4, and a controller 3. The voltage converter 2 is configured to convert a DC voltage supplied from a DC power supply 1 into a predetermined DC voltage (an output voltage $V_{out}$ in an example of FIG. 1A). The detector 4 is configured to detect the predetermined DC voltage ($V_{out}$) applied across the light source 20. The controller 3 is configured to control the voltage converter 2 so that a current (an output current) $I_f$ flowing through the light source 20 is constant. In the present embodiment, the lighting device 10 does not include the DC power supply 1 as a component. The DC power supply 1, for example, includes a rectifier circuit configured to rectify an AC (alternating current) voltage supplied from an AC power supply, and a power-factor correction circuit formed of a step-up chopper circuit configured to increase a voltage rectified by the rectifier circuit.

As the voltage converter 2, a step-down chopper circuit can be employed, for example. This voltage converter 2 has a first input end 2A, a second input end 2B, a first output end 2C and a second output end 2D. The first input end 2A and the second input end 2B are connected to a high potential side and a low potential side of the DC power supply 1, respectively. The voltage converter 2 is formed of a switching device Q1, a diode D1, an inductor L1, a smoothing capacitor C1, and a driving circuit 6 for driving the switching device Q1.

As the switching device Q1, a power metal oxide semiconductor field effect transistor (MOSFET) is employed, for example.

In the example of FIG. 1A, a first main terminal (a drain terminal in the present embodiment) of the switching device Q1, which serves as the first input end 2A of the voltage converter 2, is connected to the high potential side of the DC power supply 1. A control terminal (a gate terminal in the present embodiment) of the switching device Q1 is connected to the driving circuit 6. A second main terminal (a source terminal in the present embodiment) of the switching device Q1 is connected to a cathode side of the diode D1. An anode side of the diode D1, which serves as the second input end 2B of the voltage converter 2, is connected to the low potential side of the DC power supply 1. The low potential side of the DC power supply 1 is grounded.

A first end of the inductor L1 is connected to a junction between the source terminal of the switching device Q1 and the cathode side of the diode D1. A second end of the inductor L1 is connected to a high potential side of the capacitor C1, which serves as the first output end 2C of the voltage converter 2. A low potential side of the capacitor C1, which serves as the second output end 2D of the voltage converter 2, is connected to the anode side of the diode D1 via a resistor R1.

An output of the voltage converter 2 is electrically connected to a first connector CN1. In details, the first output end 2C and the second output end 2D of the voltage converter 2 are electrically connected to a first contact CN11 and a second contact CN12 of the first connector CN1, respectively. In the example of FIG. 1A, the first connector CN1 is electrically connected between both ends of the capacitor C1. Here, the light source 20 is electrically connected to a second connector CN2 that is free to be detachably connected to the first connector CN1. In details, the first contact CN11 and the second contact CN12 of the first connector CN1 are connected to a first contact CN21 and a second contact CN22 of the second connector CN2, respectively. In the present embodiment, the first connector CN1 and the second connector CN2 are connected electrically and mechanically, thereby electrically connecting between the lighting device 10 and the light source 20. In the present embodiment, the electrical and mechanical connection between the first connector CN1 and second connector CN2 is released, thereby releasing the electrical connection between the lighting device 10 and the light source 20. Thus, the light source 20 is attachable to and detachable from the lighting device 10 of the present embodiment. The lighting device of the present embodiment includes the first connector CN1 as a component.

The detector 4 may be formed of a resistance voltage-dividing circuit, for example. The resistance voltage-dividing circuit is formed of a series circuit of a resistor R2 and a resistor R3, and a resistor R4 that is connected in series to the series circuit, for example. In the example of FIG. 1A, the detector 4 is connected between the first output end 2C and the second input end 2B of the voltage converter 2.

A first end of the resistor R2 is electrically connected to the first output end 2C of the voltage converter 2 and the first contact CN11 of the first connector CN1. In the example of FIG. 1A, the first end of the resistor R2 is connected to a junction between the high potential side of the capacitor C1 and a high potential side of the first connector CN1. A second end of the resistor R2 is connected to a first end of the resistor R3. A second end of the resistor R3 is connected to a first end of the resistor R4. A second end of the resistor R4 is grounded. Thus, the detector 4 can resistively divide the DC voltage (the output voltage $V_{out}$) converted by the voltage converter 2.

The controller 3 includes a control integrated circuit (IC) 12 configured to control the driving circuit 6.

The control IC 12 is connected to the driving circuit 6. The control IC 12 is also connected, via a resistor R5, to a first end of a secondary winding L2 that is magnetically coupled to the inductor L1 forming a primary winding. A second end of the secondary winding L2 is connected to the anode side of the diode D1. Thus, the control IC 12 can detect a current flowing through the inductor L1. The control IC 12 is configured to control the driving circuit 6 so that the driving circuit 6 turns on the switching device Q1 when a value of the current flowing through the inductor L1 is zero.

The control IC 12 is electrically connected, via a resistor R6, to the second output end 2D of the voltage converter 2 (a junction between the low potential side of the capacitor C1 and the resistor R1). In the present embodiment, the resistor R1 defines a resistor for current-voltage conversion adapted to convert a current flowing through the switching device Q1 into a voltage to detect the voltage corresponding to the current. The control IC 12 is configured to receive the voltage corresponding to the current, converted through the resistor R1, and thereby to detect a current flowing through the switching device Q1.

The control IC 12 is connected to a positive terminal (a plus side) of a DC power supply E1 via a resistor R7. A negative terminal (a minus side) of the DC power supply E1 is grounded. In the present embodiment, the resistor R7 and the DC power supply E1 constitute a first setting unit 7 configured to set a threshold voltage for turning off the switching device Q1. In the present embodiment, the threshold voltage set by the first setting unit 7 is input to the control IC 12. The DC power supply E1 is configured to generate a variable output voltage.

The control IC 12 is configured to control the driving circuit 6 so that the driving circuit 6 turns off the switching device Q1 when the voltage converted through the resistor R1 arrives at the threshold voltage.

The controller 3 can make a current $I_f$ flowing through the light source 20 substantially constant by turning on and off the switching device Q1 through the driving circuit 6.

The lighting device 10 includes a determination unit 5 configured to determine whether a detection voltage $V_A$ from the detector 4 is a preset first reference voltage $V_S$ or higher.

The determination unit 5 includes a comparator CP1, a second setting unit 8 configured to set the first reference voltage $V_S$, and a resistor R8.

An output terminal of the comparator CP1 is connected, via the resistor R8, to a junction between the control IC 12 and the resistor R7. An inverting input terminal of the comparator CP1 is connected to a junction between the resistor R4 and the series circuit of the resistor R2 and the resistor R3. A non-inverting input terminal of the comparator CP1 is connected to the second setting unit 8.

The second setting unit 8 includes three resistors R9 to R11 and a capacitor C2.

One end of the resistor R9 is connected to one end (a first end) of the resistor R4. Other end (A second end) of the resistor R9 is pulled up to a reference voltage $V_{ref}$ via the resistor R10. In the present embodiment, the reference voltage $V_{ref}$ is generated from the DC voltage supplied from the DC power supply 1, for example.

A first end of the resistor R11 is connected to a junction between the resistor R9 and the resistor R10. A second end of the resistor R11 is connected to the second end of the resistor R4. The first end of the resistor R11 is connected to a high potential side of the capacitor C2. A low potential side of the capacitor C2 is connected to the second end of the resistor R11. The high potential side of the capacitor C2 is connected to the non-inverting input terminal of the comparator CP1.

The first reference voltage $V_S$ is set at a voltage that is higher by a first specified voltage ($V_m$ in FIG. 2) than the detection voltage $V_A$ by the detector 4. In details, the first reference voltage $V_S$ is set higher than the detection voltage $V_A$ by the first specified voltage $V_m$ in a period in which the first reference voltage $V_S$ is constant during an operation of the voltage converter 2. In the present embodiment, the first specified voltage $V_m$ is set at a voltage of 5% of the detection voltage $V_A$ by the detector 4, for example. In other words, the first reference voltage $V_S$ is set to be "the detection voltage $V_A$ by the detector 4+(the voltage of 5% of the detection voltage $V_A$ by the detector 4)". The first specified voltage $V_m$ is set at a voltage of 5% of the detection voltage $V_A$ by the detector 4 in the present embodiment, but the present invention is not limited to this. For example, the first specified voltage $V_m$ may be set at a voltage of 1% to 10% of the detection voltage $V_A$ by the detector 4.

Figure 2:
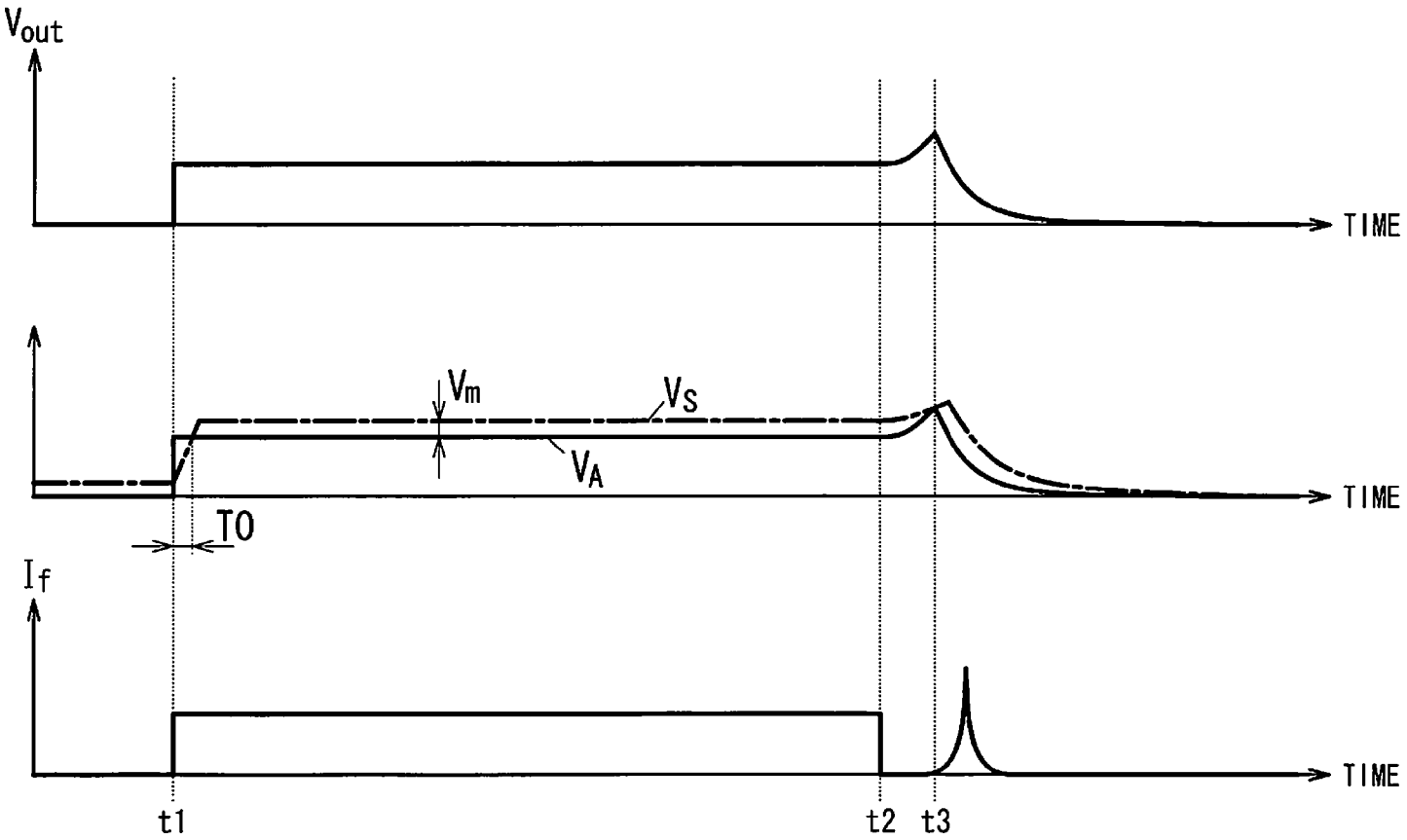
FIG. 2 is an explanatory diagram of output voltage, detection voltage, first reference voltage, and output current in the lighting device of embodiment 1.

In the lighting device 10 of the present embodiment, the output end side of the lighting device 10 comes into a no-load state when, in a lit state of the light source 20, a contact failure between the first connector CN1 and the second connector CN2 releases the electrical connection between the light source 20 and the lighting device 10 (at time t2 in FIG. 2), for example. In the lighting device 10 of the present embodiment, when the output end side of the lighting device 10 comes into the no-load state, the output voltage $V_{out}$ of the lighting device 10 increases. In the lighting device 10 of the present embodiment, when the output voltage $V_{out}$ of the lighting device 10 increases, each of the detection voltage $V_A$ of the detector 4 and the first reference voltage $V_S$ increases. In FIG. 2, the time t1 indicates the time when turning on and off (switching) of the switching device Q1 is started.

The lighting device 10 of the present embodiment is set so that a rising period of the first reference voltage $V_S$ is longer than a rising period of the detection voltage $V_A$ by the detector 4 after the electrical connection between the light source 20 and the lighting device 10 is released in a lit state of the light source 20. In other words, the lighting device 10 of the present embodiment is set so that, when the electrical connection between the light source 20 and the lighting device 10 is released in the lit state of the light source 20, the first reference voltage $V_S$ varies more slowly than the detection voltage $V_A$ by the detector 4. In short, the first reference voltage $V_S$ is set to vary more slowly than the detection voltage $V_A$ by the detector 4. Specifically, in the present embodiment, a time constant of the determination unit 5 is set larger than those of the voltage converter 2 and controller 3 so that the first reference voltage $V_S$ varies more slowly than the detection voltage $V_A$ by the detector 4. In the present embodiment, the time constant of the determination unit 5 is set at a time constant determined by the resistors R9 to R11 and the capacitor C2, for example. In the present embodiment, the time constant of the voltage converter 2 is set at a time constant determined by the inductor L1 and the capacitor C1, for example. In the present embodiment, furthermore, a time constant of the controller 3 depends on a response speed of the control IC 12.

In the lighting device 10 of the present embodiment, since the first reference voltage $V_S$ is varied more slowly than the detection voltage $V_A$ by the detector 4, a period (T0) in which the detection voltage $V_A$ by the detector 4 is higher than the first reference voltage $V_S$ exists after the switching device Q1 starts to turn on and off (time t1 in FIG. 2). In the lighting device 10 of the present embodiment, therefore, in the period after the switching device Q1 starts to turn on and off until the first reference voltage $V_S$ becomes higher by the first specified voltage than the detection voltage $V_A$ by the detector 4, the controller 3 neglects the determination result by the determination unit 5.

The detection voltage $V_A$ by the detector 4 is input to the inverting input terminal of the comparator CP1. The first reference voltage $V_S$ set by the second setting unit 8 is input to the non-inverting input terminal of the comparator CP1.

The comparator CP1 compares the detection voltage $V_A$ by the detector 4 input to the inverting input terminal with the first reference voltage $V_S$ input to the non-inverting input terminal. When the detection voltage $V_A$ by the detector 4 is the first reference voltage $V_S$ or higher, the comparator CP1 changes the output thereof from the high level to the low level.

In the lighting device 10 of the present embodiment, when the output of the comparator CP1 changes from the high level to the low level, the threshold voltage input to the control IC 12 decreases. When the threshold voltage, which is set by the first setting unit 7, becomes a preset first set voltage or lower, the control IC 12 fixes the output thereof to the low level.

In the lighting device 10 of the present embodiment, when the output of the control IC 12 is fixed to the low level, the OFF state of the switching device Q1 is kept by the driving circuit 6. Thus, when the detection voltage $V_A$ by the detector 4 is determined to be the first reference voltage $V_S$ or higher through the determination unit 5, the controller 3 can stop the operation of the voltage converter 2.

Figure 3:
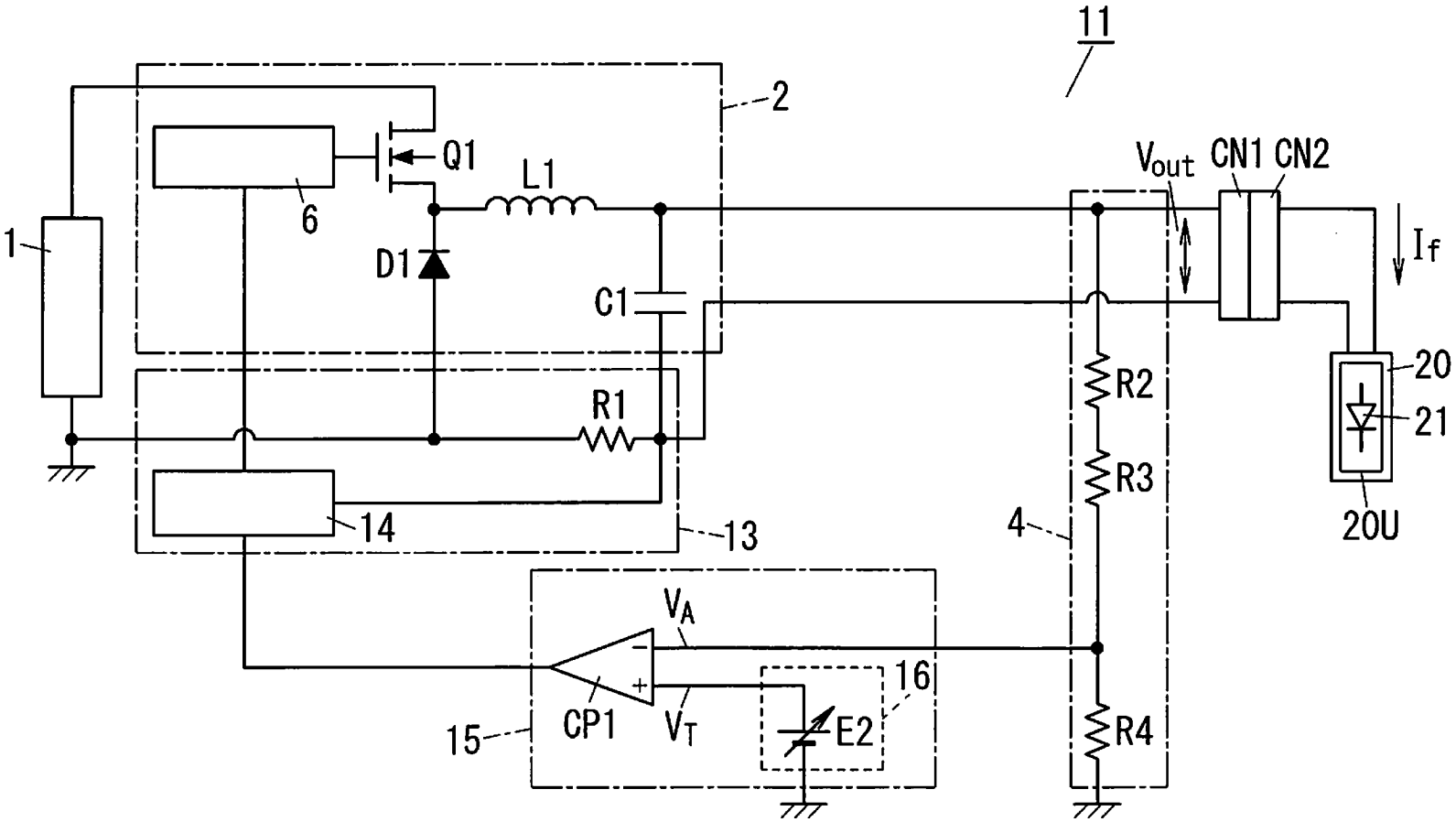
FIG. 3 is a schematic circuit diagram of a lighting device as a comparative example.

The inventors have considered a lighting device 11 of a comparative example having the configuration of FIG. 3. This lighting device 11 is configured to light a light source 20 similarly to the lighting device 10 of the present embodiment. Hereinafter, in the lighting device 11 of the comparative example, components similar to those of the lighting device 10 of the present embodiment are denoted with the same reference signs, and the descriptions of those components are omitted.

The lighting device 11 of the comparative example includes a voltage converter 2, a detector 4, a controller 13, and a determination unit 15. The controller 13 is configured to control the voltage converter 2 so that a current $I_f$ flowing through the light source 20 is constant. The determination unit 15 is configured to determine whether a detection voltage $V_A$ by the detector 4 is a preset comparative voltage $V_T$ or higher.

The controller 13 includes a control circuit 14 configured to control the driving circuit 6.

The control circuit 14 is connected to a junction between a resistor R1 and a low potential side of a capacitor C1. The control circuit 14 is configured to receive a voltage converted through the resistor R1 for current-voltage conversion to detect a current that flows through a switching device Q1.

The control circuit 14 is connected to a driving circuit 6. The control circuit 14 is configured to output, to the driving circuit 6, a switching signal for controlling the ON and OFF of the switching device Q1 so that the voltage converted through the resistor R1 becomes equal to a preset second set voltage. The driving circuit 6 is configured to turn on and off the switching device Q1 in accordance with a switching signal from the control circuit 14. Thus, the controller 13 can make the current $I_f$ flowing through the light source 20 substantially constant.

The control circuit 14 is connected to an output terminal of a comparator CP1.

The determination unit 15 includes the comparator CP1 and a third setting unit 16 for setting the comparative voltage $V_T$.

The third setting unit 16 includes a DC power supply E2. A positive terminal (a plus side) of the DC power supply E2 is connected to a non-inverting input terminal of the comparator CP1. A negative terminal (a minus side) of the DC power supply E2 is grounded. The DC power supply E2 is configured to generate a variable output voltage.

The comparative voltage $V_T$ set by the third setting unit 16 is input to the non-inverting input terminal of the comparator CP1.

The comparator CP1 is configured to compare the detection voltage $V_A$ by the detector 4 input to the inverting input terminal with the comparative voltage $V_T$ input to the non-inverting input terminal. The comparator CP1 changes the output thereof from the high level to the low level when the detection voltage $V_A$ by the detector 4 is the comparative voltage $V_T$ or higher.

When the output of the comparator CP1 changes from the high level to the low level, the control circuit 14 keeps the OFF state of the switching device Q1 through the driving circuit 6. Thus, when the detection voltage $V_A$ by the detector 4 is determined to be the comparative voltage $V_T$ or higher through the determination unit 15, the controller 13 can stop the operation of the voltage converter 2.

Figure 4:
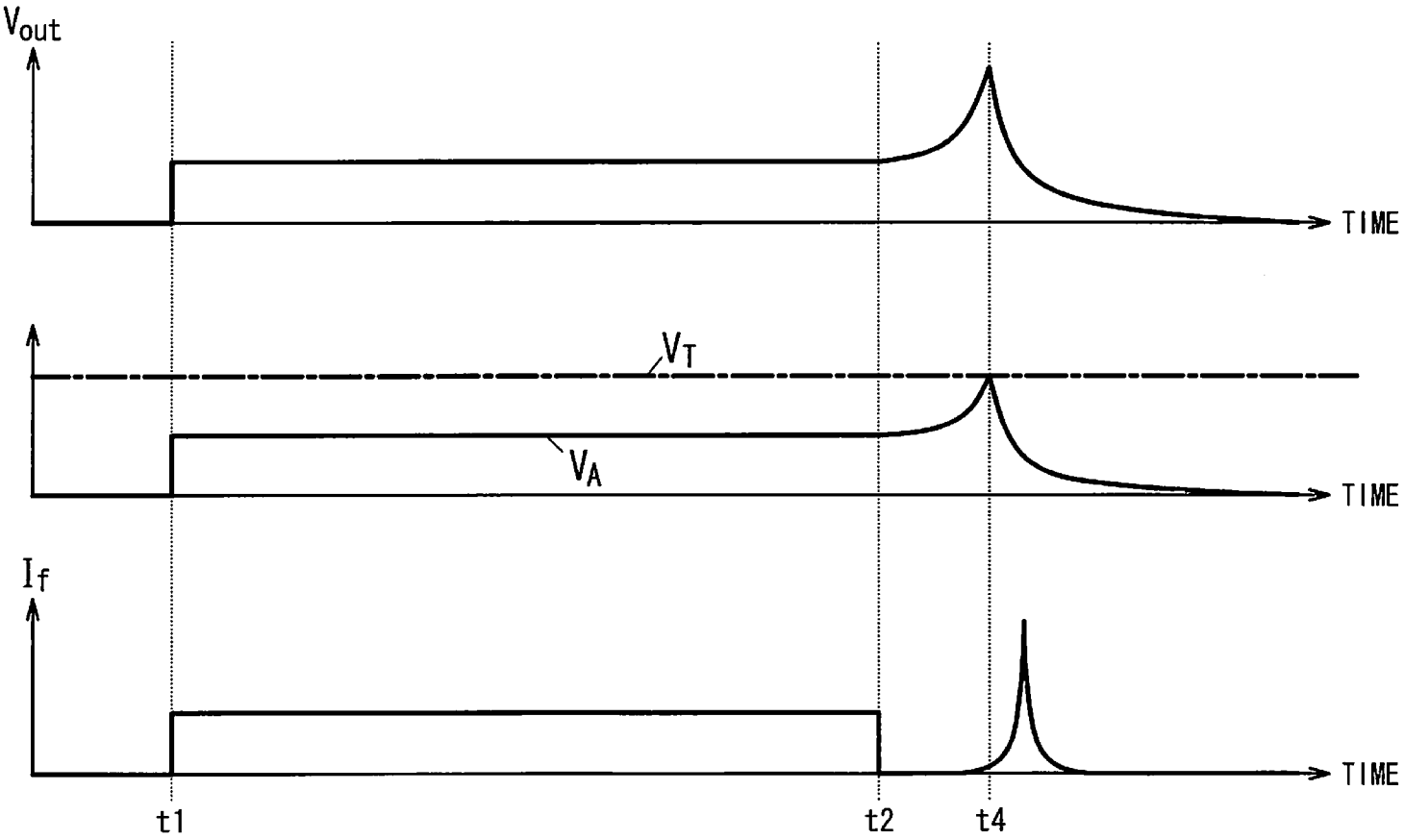
FIG. 4 is an explanatory diagram showing an example of output voltage, detection voltage, comparative voltage, and output current in the lighting device of the comparative example.

In the lighting device 11 of the comparative example, in order to prevent accidental stop of the operation of the voltage converter 2 from occurring when lighting of the light source 20 is started, the comparative voltage $V_T$ is set to a voltage higher than the output voltage $V_{out}$ of the lighting device 11 (see FIG. 4). The time t1 in FIG. 4 indicates the time when turning on and off of the switching device Q1 is started.

The inventors have considered, for example, a large variation in forward voltage (forward-direction voltage) of the LED devices 21 with respect to a possibility that accidental stop of the operation of the voltage converter 2 occurs when lighting of the light source 20 is started. In this case, the comparative voltage $V_T$ can be set in consideration of the upper limit value of variation in forward voltage of the LED devices 21. The inventors have also considered, for example, a plurality of different LED devices 21 with different forward voltages to be employed with respect to the possibility that accidental stop of the operation of the voltage converter 2 occurs when lighting of the light source 20 is started. In this case, the comparative voltage $V_T$ can be set in consideration of the highest of the forward voltages of the plurality of different LED devices 21. The inventors have also considered, for example, applying the predetermined DC voltage to two or more (e.g. N: N≥2) LED devices 21 in series with respect to the possibility that accidental stop of the operation of the voltage converter 2 occurs when lighting of the light source 20 is started. In this case, the comparative voltage $V_T$ can be set in consideration of a total forward voltage of the two or more LED devices 21. In other words, in the lighting device 11 of the comparative example, the comparative voltage $V_T$ is set higher than the output voltage $V_{out}$ of the lighting device 11 in consideration of these cases.

In the lighting device 11 of the comparative example, when the electrical connection between the light source 20 and the lighting device 11 is released in the lit state of the light source 20 (at time t2 in FIG. 4), the output voltage $V_{out}$ of the lighting device 11 increases until the detection voltage $V_A$ by the detector 4 reaches the comparative voltage $V_T$. In the lighting device 11 of the comparative example, when the light source 20 is electrically connected to the lighting device 11 again after an output voltage $V_{out}$ of the lighting device 11 increases (at time t4 in FIG. 4), an overcurrent may flow through the light source 20.

Figure 5:
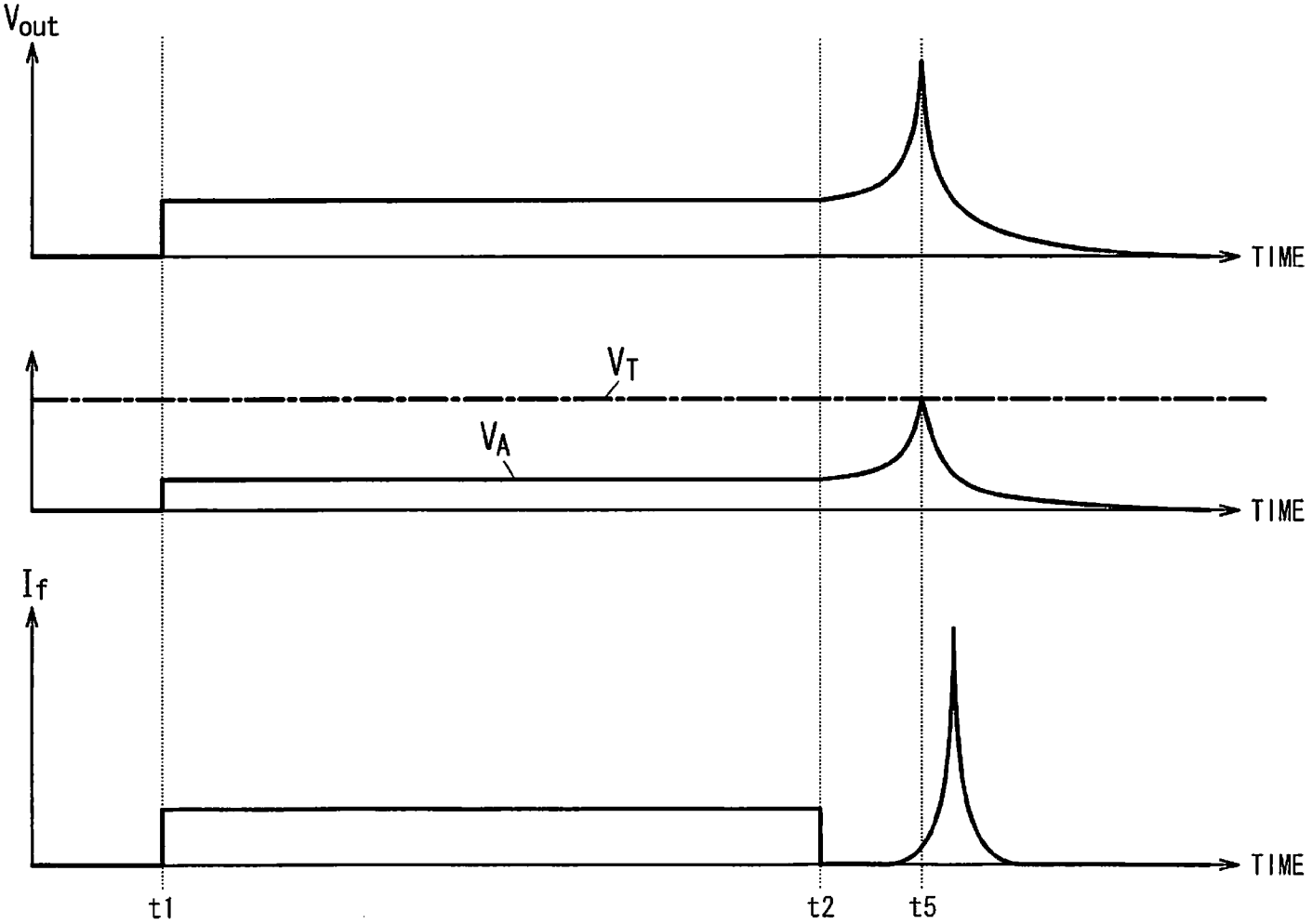
FIG. 5 is an explanatory diagram showing another example of output voltage, detection voltage, comparative voltage, and output current in the lighting device of the comparative example.

In the lighting device 11 of the comparative example, for example, a case is also considered where another light source (hereinafter referred to as "second light source") including LED devices 21 that have a forward voltage corresponding to a lower limit value of variation in forward voltage is lit. When the electrical connection between the second light source and the lighting device 11 is released in the lit state of the second light source (at time t2 in FIG. 5), the output voltage $V_{out}$ of the lighting device 11 steeply increases comparing with the case where the light source (first light source) 20 is lit. Here, the first light source includes LED devices 21 having a forward voltage higher than that of the second light source. Therefore, in the lighting device 11 of the comparative example, when the second light source is electrically connected to the lighting device 11 again after an output voltage $V_{out}$ of the lighting device 11 increases (at time t5 in FIG. 5), a relatively large overcurrent can flow through the second light source. In FIG. 5, the time t1 indicates the time when turning on and off of the switching device Q1 is started.

In the lighting device 10 of the present embodiment, the first reference voltage $V_S$, which is set by the second setting unit 8, is set higher by the first specified voltage $V_m$ than the detection voltage $V_A$ by the detector 4. Therefore, in the lighting device 10 of the present embodiment, even if the electrical connection between the light source 20 and the lighting device 10 is released in the lit state of the light source 20, an increase in output voltage $V_{out}$ of the lighting device 10 can be suppressed comparing with the lighting device 11 of the comparative example. Therefore, in the lighting device 10 of the present embodiment, even if the light source 20 is electrically connected to the lighting device 10 again after the output voltage $V_{out}$ of the lighting device 10 increases (at time t3 in FIG. 2), an overcurrent can be inhibited from flowing through the light source 20 comparing with the lighting device 11 of the comparative example.

In the lighting device 10 of the present embodiment, in the case where the second light source is lit, even if the electrical connection between the second light source and the lighting device 10 is released in the lit state of the second light source, an increase in lighting device's 10 output voltage $V_{out}$ can be suppressed comparing with the lighting device 11 of the comparative example. Therefore, in the lighting device 10 of the present embodiment, even if the second light source is electrically connected to the lighting device 10 again after an output voltage $V_{out}$ of the lighting device 10 increases, an overcurrent can be inhibited from flowing through the second light source comparing with the lighting device 11 of the comparative example. In other words, in the lighting device 10 of the present embodiment, in the case where any of the light sources (e.g. the first light source 20 and second light source) having different rated voltages is lit, an overcurrent can be inhibited from flowing through a light source to be lit. That is, in the lighting device 10 of the present embodiment, an overcurrent can be inhibited from flowing through the light source comparing with conventional LED driving devices.

In the lighting device 10 of the present embodiment, the inventors have verified, by experiments, that an overcurrent can be inhibited from flowing through the light source 20 even in the case where the lowest of the forward voltages of the plurality of different LED devices 21 is considered. In the lighting device 10 of the present embodiment, the inventors have verified, by experiments, that an overcurrent can be inhibited from flowing through the light source 20 even in the case where a total forward voltage of (N−1) LED devices is considered.

In the lighting device 10 of the present embodiment, the first reference voltage $V_S$, which is set by the second setting unit 8, is set higher by the first specified voltage $V_m$ than the detection voltage $V_A$ by the detector 4, and is set to vary more slowly than the detection voltage $V_A$ by the detector 4. Therefore, in the lighting device 10 of the present embodiment, accidental stop of the operation of the voltage converter 2 can be prevented from occurring when lighting of the light source 20 is started. In the lighting device 10 of the present embodiment, even when the second light source having a rated voltage different from that of the first light source 20 is lit, accidental stop of the operation of the voltage converter 2 can be prevented from occurring when lighting of the second light source is started.

The lighting device 10 of the present embodiment may have a configuration where an LED unit 20U including a plurality of LED devices 21 connected in series or parallel can be lit. In this case, preferably, the lighting device 10 of the present embodiment can be applied to the light source 20 where at least two LED units 20U are connected in series. Thus, in the lighting device 10 of the present embodiment, even if the electrical connection between the light source 20 and the lighting device 10 is released in the lit state of the light source 20, an increase in lighting device's 10 output voltage $V_{out}$ can be suppressed comparing with the lighting device 11 of the comparative example. Therefore, in the lighting device 10 of the present embodiment, even if the light source 20 is electrically connected to the lighting device 10 again after an output voltage $V_{out}$ of the lighting device 10 increases, an overcurrent can be inhibited from flowing through the light source 20 comparing with the lighting device 11 of the comparative example.

The lighting device 10 of the present embodiment does not include the DC power supply 1 as a component, but may include the DC power supply 1 as a component. In the present embodiment, the DC power supply 1 is formed of an AC power supply, a rectifier circuit, and a power-factor correction circuit, but is not limited to this. For example, the DC power supply 1 may be formed of a DC power supply, a storage battery, or a solar battery.

The above-mentioned present embodiment provides the lighting device 10 configured to be detachably attached with the light source 20 including LED devices 21 as a lighting object. The lighting device 10 includes the voltage converter 2 configured to convert the DC voltage supplied from the DC power supply 1 into the predetermined DC voltage, and the detector 4 configured to detect the predetermined DC voltage applied across the light source 20 to generate a detection voltage $V_A$. The lighting device 10 also includes the controller 3 configured to control the voltage converter 2 so that a current $I_f$ flowing through the light source 20 is constant, and a determination unit 5 configured to determine whether the detection voltage $V_A$ by the detector 4 is the preset first reference voltage $V_S$ or higher. In the lighting device 10, the first reference voltage $V_S$ is set higher by the specified voltage (the first specified voltage) $V_m$ than the detection voltage $V_A$ by the detector 4, and is set to vary more slowly than the detection voltage $V_A$ by the detector 4. In the lighting device 10, when the detection voltage $V_A$ by the detector 4 is determined to be equal to the first reference voltage $V_S$ through the determination unit 5, the controller 3 stops the operation of the voltage converter 2. Thus, in the present embodiment, even if the electrical connection between the light source 20 and the lighting device 10 is released in the lit state of the light source 20, an increase in lighting device's 10 output voltage $V_{out}$ can be suppressed comparing with the lighting device 11 of the comparative example. In the present embodiment, even if the light source 20 is electrically connected to the lighting device 10 again after an output voltage $V_{out}$ of the lighting device 10 increases, an overcurrent can be inhibited from flowing through the light source 20 comparing with the lighting device 11 of the comparative example.

In the present embodiment, the first reference voltage $V_S$ is set higher by the first specified voltage $V_m$ than the detection voltage $V_A$ by the detector 4, and is set to vary more slowly than the detection voltage $V_A$ by the detector 4. Thus, in the present embodiment, in the case where any of a plurality of light sources 20 having different rated voltages is lit, an overcurrent can be inhibited from flowing through the light sources 20.

Figure 6:
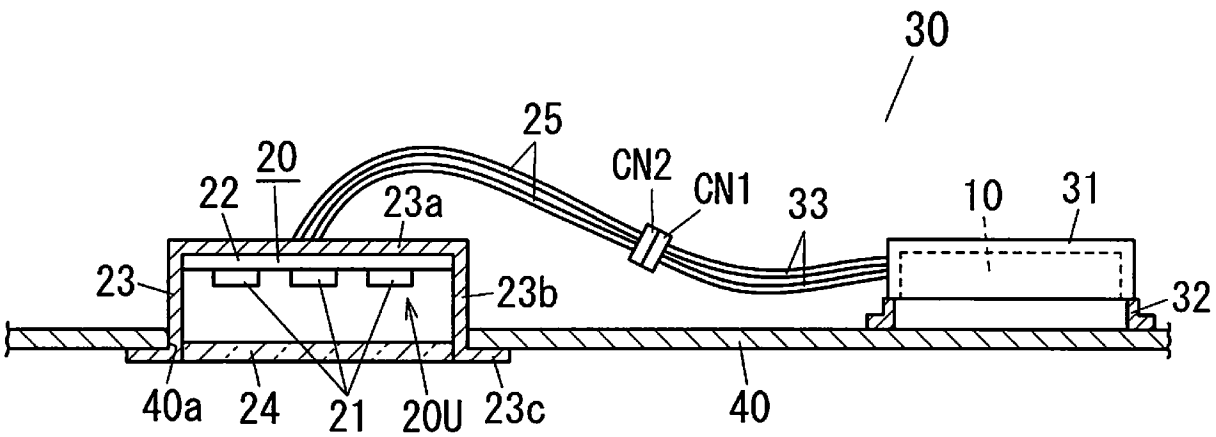
FIG. 6 is a schematic sectional diagram of a luminaire of embodiment 1.

Hereinafter an example of a luminaire including the lighting device 10 of the present embodiment is described with reference to FIG. 6.

The luminaire 30 of the present embodiment is a luminaire to be embedded in a ceiling material 40, for example. The luminaire 30 includes the light source 20, the lighting device 10, and a casing 31 shaped like a box (a rectangular box in the present embodiment) for storing the lighting device 10.

The casing 31 may be made of metal (e.g. iron, aluminum, or stainless steel), for example. In the present embodiment, the casing 31 is disposed on one surface side (an upper surface side in FIG. 6) of the ceiling material 40. In the present embodiment, a spacer 32 is intervened between the casing 31 and the ceiling material 40 in order to keep the distance between the casing 31 and ceiling material 40 at a specified value.

A first guide hole (not shown) is formed in one side wall (a left wall in FIG. 6) of the casing 31 in order to guide a first connecting wire 33 electrically connected to the lighting device 10. The lighting device 10 is electrically connected to the first connector CN1 via the first connecting wire 33.

The light source 20 includes a plurality of LED devices 21, and a mounting substrate 22 on which the plurality of LED devices 21 are mounted.

For example, a metal-base printed-wiring board or the like may be employed as the mounting substrate 22. In the present embodiment, the outer peripheral shape of the mounting substrate 22 is set as a circular shape, for example.

The mounting substrate 22 is electrically connected to the second connector CN2 via a second connecting wire 25. The plurality of LED devices 21 are mounted on one surface side (a lower surface side in FIG. 6) of the mounting substrate 22. FIG. 6 shows three of the plurality of LED devices 21.

The luminaire 30 includes a body 23 shaped like a closed-end cylinder (a closed-end circular cylinder in the present embodiment) to which the mounting substrate 22 is attached.

The body 23 may be made of metal (e.g. iron, aluminum, or stainless steel), for example.

A second guide hole (not shown) is formed in an upper base 23*a* of the body 23 in order to guide the second connecting wire 25 electrically connected to the mounting substrate 22. Here, in the present embodiment, a plane size of the mounting substrate 22 is set slightly smaller than an opening size of the body 23.

In the luminaire 30 of the present embodiment, the mounting substrate 22 is disposed on an inside of the upper base 23*a* of the body 23. In the present embodiment, the mounting substrate 22 is attached on the upper base 23*a* of the body 23. In the present embodiment, an adhesive sheet (not shown) having an electrical insulating property and thermal conductivity is used for attaching the mounting substrate 22 to the upper base 23*a* of the body 23, for example.

A collar 23*c* extended sideward is formed at a lower end of a side wall 23*b* of the body 23. A pair of fittings (not shown) is also provided at the lower end of the side wall 23*b* of the body 23 and configured to support a periphery of a burying hole 40*a* previously formed in the ceiling material 40 along with the collar 23*c*. In the present embodiment, by supporting the periphery of the burying hole 40*a* in the ceiling material 40 along with the pair of fittings and the collar 23*c*, the body 23 can be embedded in the ceiling material 40.

The luminaire 30 includes a light diffusion plate 24 configured to cover the opening in the body 23 and to diffuse a light emitted from each LED device 21.

The light diffusion plate 24 may be made of an optically-transparent material (e.g. acrylic resin or glass). In the present embodiment, the light diffusion plate 24 is shaped like a disk, for example. In the present embodiment, the light diffusion plate 24 is detachably attached on the lower end of the side wall 23*b* of the body 23.

As discussed above, the luminaire 30 of the present embodiment includes the light source 20 and the lighting device 10. Thus, in the luminaire 30 of the present embodiment, it is possible to provide a luminaire including the lighting device 10 capable of inhibiting an overcurrent from flowing through the light sources 20.

Embodiment 2

Figure 7:
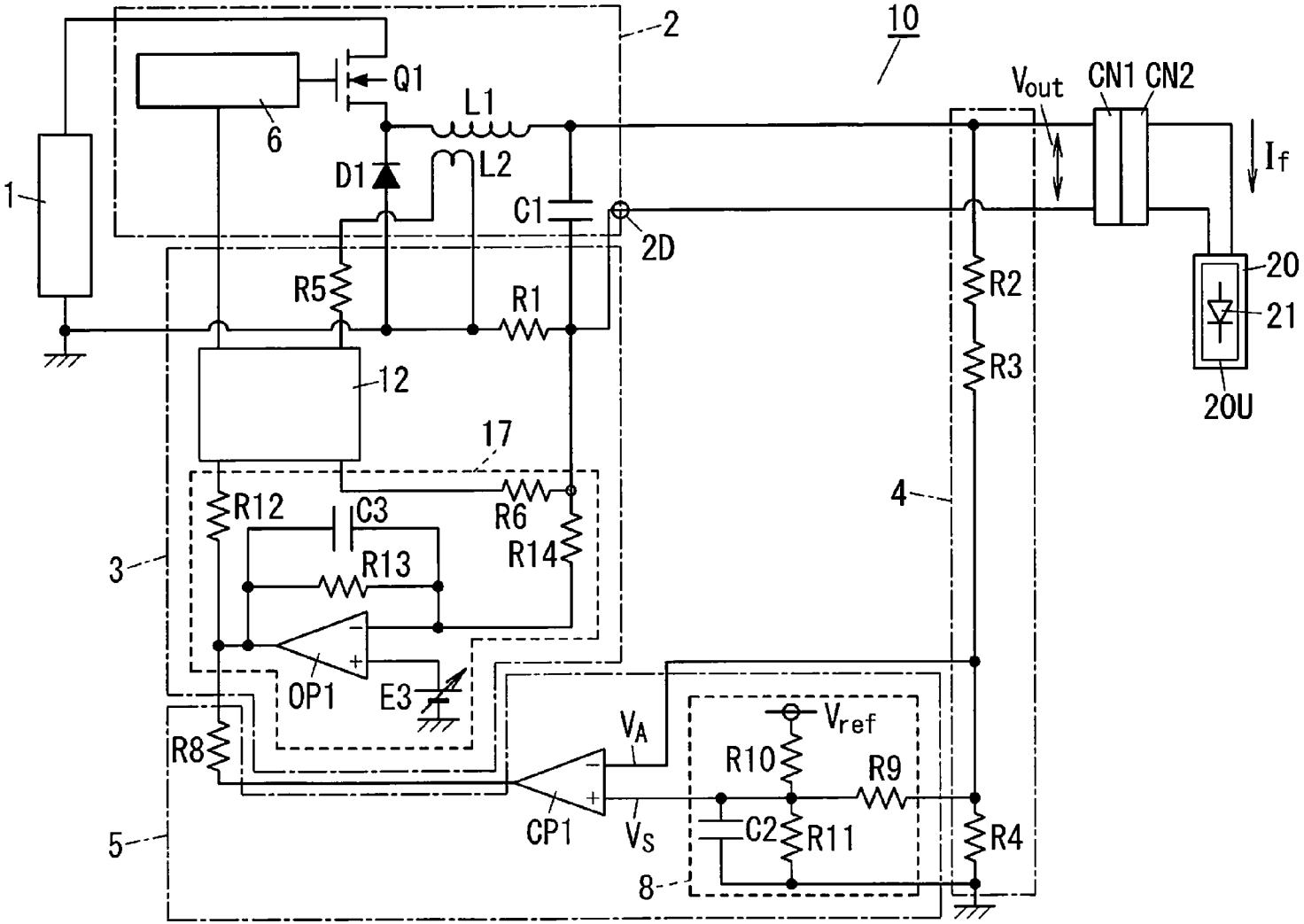
FIG. 7 is a schematic circuit diagram of a lighting device of embodiment 2.

The basic configuration of a lighting device 10 of embodiment 2 is similar to that of embodiment 1. As shown in FIG. 7, embodiment 2 differs from embodiment 1 in that the lighting device 10 includes, instead of the first setting unit 7 of embodiment 1, a dimming controller 17 formed of an integrating circuit for performing an integrating operation. In embodiment 2, components similar to those in embodiment 1 are denoted with the same reference signs, and the descriptions of those components are omitted appropriately.

The dimming controller 17 includes three resistors R12 to R14, a capacitor C3, an operational amplifier OP1, and a DC power supply E3.

The resistor R12 is disposed in a feeding path between an control IC 12 and a resistor R8.

An output terminal of the operational amplifier OP1 is connected to a junction between the resistor R12 and the resistor R8. An output terminal of the operational amplifier OP1 is connected to an inverting input terminal of the operational amplifier OP1 via the resistor R13. The capacitor C3 is connected in parallel to the resistor R13.

The inverting input terminal of the operational amplifier OP1 is connected, via the resistor R14, to a second output end 2D (an opposite side of the resistor R6 from a junction between the resistor R6 and the control IC 12) of a voltage converter 2. A non-inverting input terminal of the operational amplifier OP1 is connected to a positive terminal (a plus side) of the DC power supply E3. A negative terminal (a minus side) of the DC power supply E3 is grounded. The DC power supply E3 is configured to generate a variable output voltage.

A first voltage signal corresponding to a voltage converted through a resistor R1 for current-voltage conversion is input to the inverting input terminal of the operational amplifier OP1. A second voltage signal corresponding to a voltage from the DC power supply E3 is input to the non-inverting input terminal of the operational amplifier OP1. In the present embodiment, the second voltage signal from the DC power supply E3 is used as a dimming signal for dimming and lighting the light source 20. In the present embodiment, for convenience of description, the second voltage signal from the DC power supply E3 is called a dimming signal from the DC power supply E3.

The operational amplifier OP1 is configured to integrate an output level of the first voltage signal input to the inverting input terminal of the operational amplifier OP1 and an output level of the dimming signal input to the non-inverting input terminal of the operational amplifier OP1. The operational amplifier OP1 is also configured to supply a result of the integrating operation, as an output signal, to the control IC 12. In the present embodiment, the output level of the output signal input to the control IC 12 defines the threshold voltage.

In the lighting device 10 of the present embodiment, an operation of dimming and lighting the light source 20 is described. In the present embodiment, an operation of reducing a light output of the light source 20 is described as an example of the operation of dimming and lighting the light source 20. In the description of the present embodiment, the output level of the dimming signal from the DC power supply E3 is set low.

In the lighting device 10 of the present embodiment, when the output level of the first voltage signal input to the inverting input terminal of the operational amplifier OP1 is higher than that of the dimming signal from the DC power supply E3, the output level of the output signal from the operational amplifier OP1 decreases.

Since the output level of the output signal from the operational amplifier OP1 decreases, the control IC 12 can shorten an ON period of a switching device Q1 set by a driving circuit 6. Thus, in the present embodiment, a current $I_f$ flowing through the light source 20 can be reduced and the light output of the light source 20 can be reduced. In other words, in the present embodiment, the light source 20 can be dimmed and lit.

The lighting device 10 of the present embodiment may be used for the luminaire 30 as described in embodiment 1.

Embodiment 3

Figure 8:
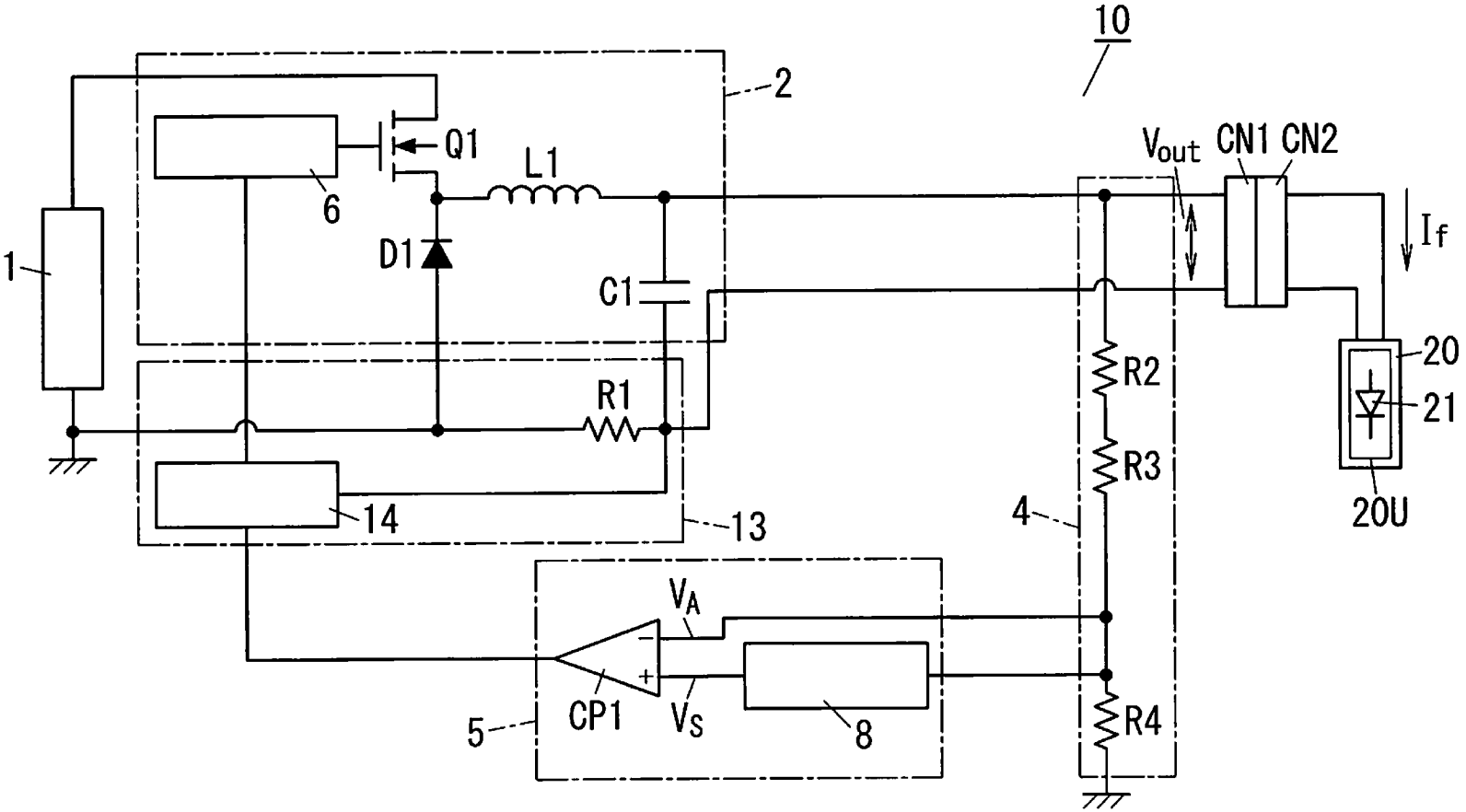
FIG. 8 is a schematic circuit diagram of a lighting device of embodiment 3.

The basic configuration of a lighting device 10 of embodiment 3 is similar to that of embodiment 1. As shown in FIG. 8, embodiment 3 differs from embodiment 1 in the configuration of a second setting unit 8. In embodiment 3, components similar to those in embodiment 1 are denoted with the same reference signs, and the descriptions of those components are omitted appropriately.

A second setting unit 8 can be configured by installing an appropriate program in a microcomputer, for example.

The second setting unit 8 is connected to a non-inverting input terminal of a comparator CP1. The second setting unit 8 is connected to a first end of a resistor R4.

The lighting device 10 of the present embodiment includes a controller 13 disposed in the lighting device 11 of the comparative example, instead of the controller 3 of embodiment 1.

An output terminal of the comparator CP1 is connected to a control circuit 14 of the controller 13.

In the lighting device 10 of the present embodiment, a first reference voltage $V_S$ is previously stored in the second setting unit 8. Specifically, the first reference voltage $V_S$ to be set in response to a detection voltage $V_A$ by the detector 4 is previously stored as a data table in the second setting unit 8. The first reference voltage $V_S$ to be set in response to the detection voltage $V_A$ by the detector 4 is previously stored as the data table in the second setting unit 8 in the present embodiment, but is not limited to this. For example, the second setting unit 8 may be configured to sequentially detect a detection voltage $V_A$ by the detector 4 to generate a first reference voltage $V_S$ based on the detection voltage $V_A$.

The second setting unit 8 is configured to output a third voltage signal corresponding to the first reference voltage $V_S$ to a non-inverting input terminal of the comparator CP1.

The first reference voltage $V_S$ is set to be higher than the detection voltage ($V_A$) obtained from a predetermined DC voltage ($V_{out}$) in at least a first specified period T1 (see FIG. 9) after the time (t1) when the predetermined DC voltage ($V_{out}$) is output from a voltage converter 2. Specifically, the first reference voltage $V_S$ is set to a voltage higher by a second specified voltage than the highest of the forward voltages of a plurality of different LED devices in at least the first specified period T1 after the time (time t1 of FIG. 9) when the switching device Q1 starts to turn on and off. In the present embodiment, the second specified voltage is set at a voltage corresponding to 5% of the highest of the forward voltages of the plurality of different LED devices. In other words, the first reference voltage $V_S$ is set to be "the highest of the forward voltages of the plurality of different LED devices+(the voltage corresponding to 5% of the highest of the forward voltages of the plurality of different LED devices)" in the first specified period T1 after the time when the switching device Q1 starts to turn on and off. Therefore, in the present embodiment, even where the LED devices 21 have a large variation in forward voltage for example, accidental stop of the operation of the voltage converter 2 can be prevented from occurring when lighting of the light source 20 is started. The second specified voltage is set at a voltage corresponding to 5% of the highest of the forward voltages of the plurality of different LED devices in the present embodiment, but is not limited to this. For example, the second specified voltage may be set at a voltage corresponding to 1% to 10% of the highest of the forward voltages of the plurality of different LED devices.

The first reference voltage $V_S$ is set to be higher by the first specified voltage than the detection voltage $V_A$ by the detector 4 after a lapse of the first specified period T1 after the time when the switching device Q1 starts to turn on and off. Thus, in the present embodiment, even if the electrical connection between the light source 20 and the lighting device 10 is released in the lit state of the light source 20 (time t2 in FIG. 9), an increase in output voltage $V_{out}$ of the lighting device 10 can be suppressed comparing with the lighting device 11 of the comparative example.

The first reference voltage $V_S$ is set so that, when the detection voltage $V_A$ by the detector 4 increases (time t2 in FIG. 9), the first reference voltage $V_S$ decreases in stages at intervals of a second specified period T3 that is longer than a rising period T2 of the detection voltage $V_A$.

Figure 9:
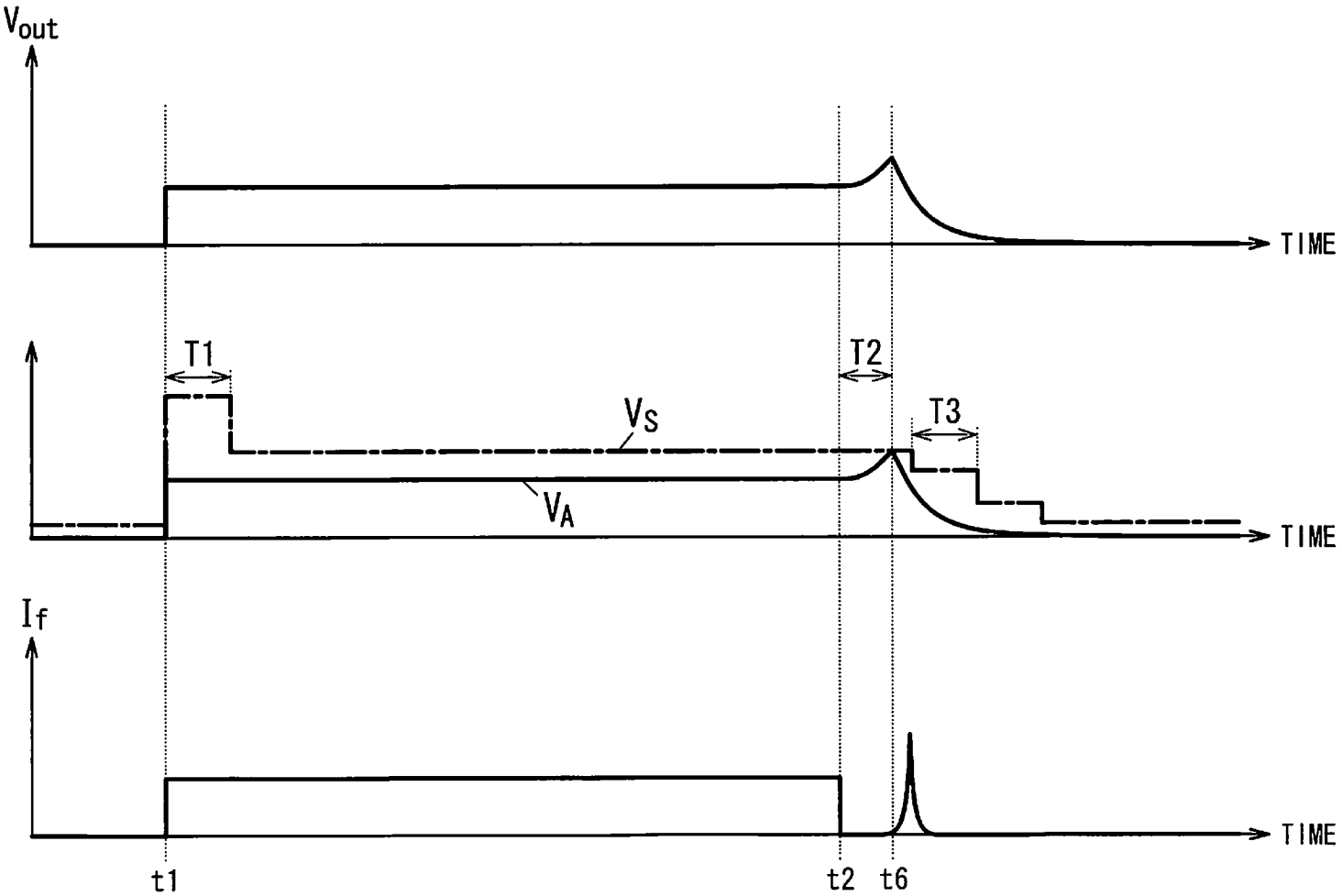
FIG. 9 is an explanatory diagram of output voltage, detection voltage, first reference voltage, and output current in the lighting device of embodiment 3.

The comparator CP1 is configured to change the output thereof from the high level to the low level when the detection voltage $V_A$ by the detector 4 input to the inverting input terminal is the first reference voltage $V_S$ or higher (time t6 in FIG. 9).

The control circuit 14 is configured to keep an OFF state of the switching device Q1 through the driving circuit 6 when the output of the comparator CP1 changes from the high level to the low level. Thus, when the detection voltage $V_A$ by the detector 4 is determined to be the first reference voltage $V_S$ or higher through the determination unit 5, the controller 13 can stop the operation of the voltage converter 2.

In the lighting device 10 of the present embodiment, even if the electrical connection between the light source 20 and the lighting device 10 is released in the lit state of the light source 20, an increase in output voltage $V_{out}$ of the lighting device 10 can be suppressed comparing with the lighting device 11 of the comparative example. Therefore, in the present embodiment, even if the light source 20 is electrically connected to the lighting device 10 again after the output voltage $V_{out}$ of the lighting device 10 increases (time t6 in FIG. 9), an overcurrent can be inhibited from flowing through the light source 20 comparing with the lighting device 11 of the comparative example.

The lighting device 10 of the present embodiment may be used for the luminaire 30 as described in embodiment 1.

Embodiment 4

Figure 10:
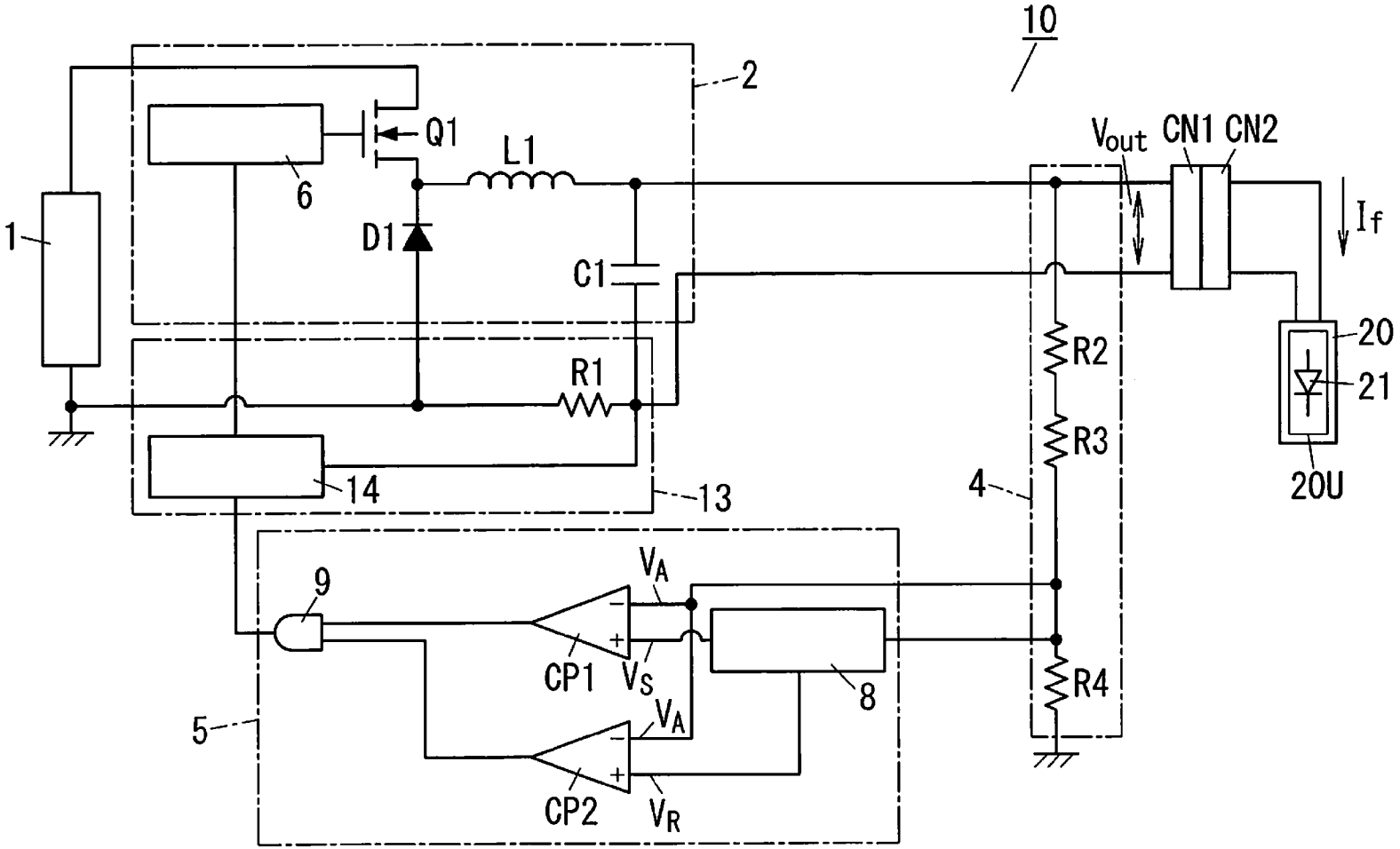
FIG. 10 is a schematic circuit diagram of a lighting device of embodiment 4.

The basic configuration of a lighting device 10 of embodiment 4 is similar to that of embodiment 3. As shown in FIG. 10, embodiment 4 differs from embodiment 3 in the configuration of a determination unit 5. In embodiment 4, components similar to those in embodiment 3 are denoted with the same reference signs, and the descriptions of those components are omitted appropriately.

The determination unit 5 includes two comparators CP1 and CP2, a second setting unit 8, and an AND circuit 9.

An output terminal of the AND circuit 9 is connected to a control circuit 14. A first input terminal of the AND circuit 9 is connected to an output terminal of the comparator CP1. A second input terminal of the AND circuit 9 is connected to an output terminal of the comparator CP2.

An inverting input terminal of the comparator CP1 is connected to a junction between a resistor R4 and a series circuit of a resistor R2 and a resistor R3. A non-inverting input terminal of the comparator CP1 is connected to the second setting unit 8.

An inverting input terminal of the comparator CP2 is connected to the junction between the resistor R4 and the series circuit of the resistor R2 and the resistor R3. A non-inverting input terminal of the comparator CP2 is connected to the second setting unit 8.

Figure 11:
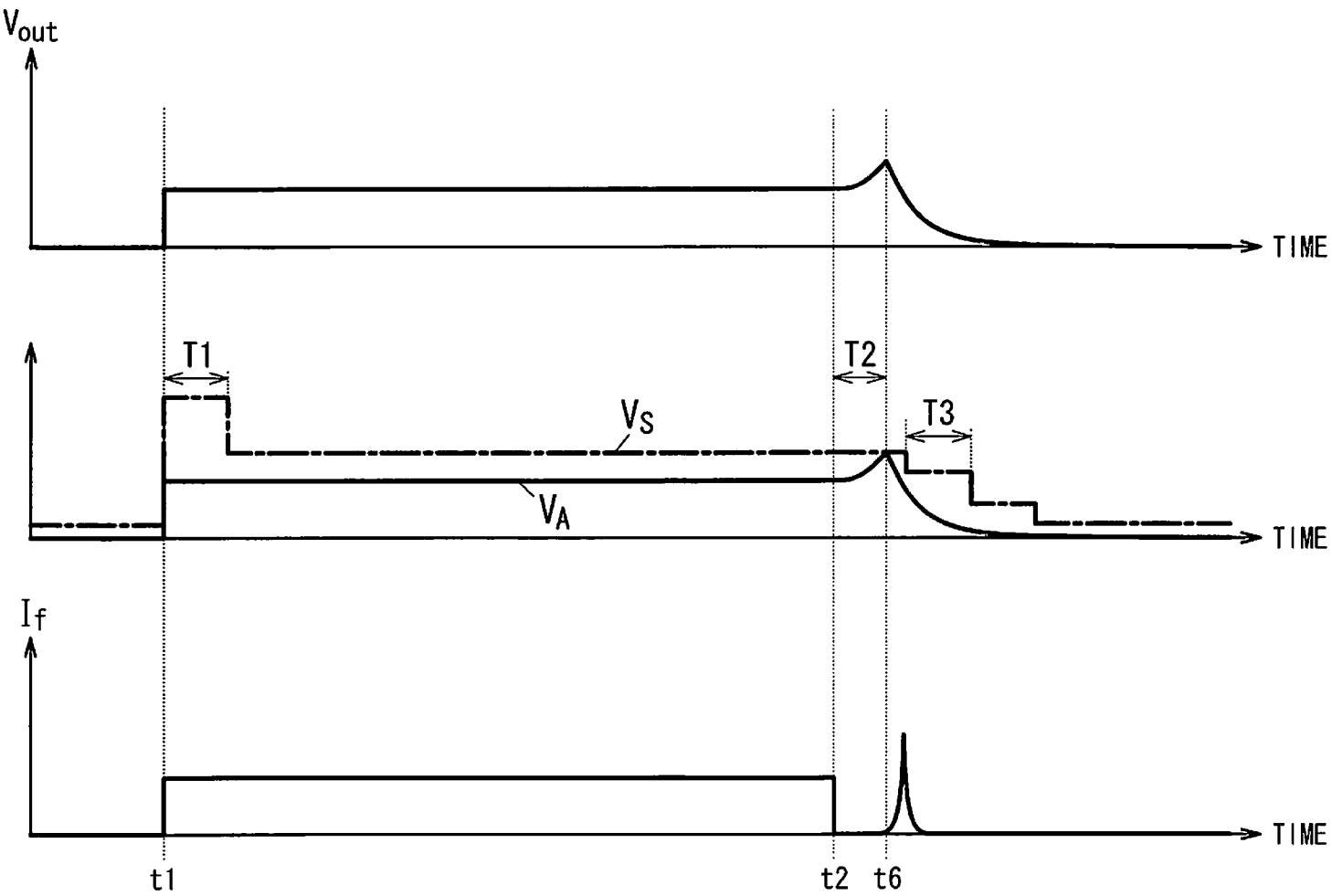
FIG. 11 is an explanatory diagram showing an example of output voltage, detection voltage, first reference voltage, second reference voltage, and output current in the lighting device of embodiment 4.

In the present embodiment, a second reference voltage $V_R$ (see FIG. 11), which is a fixed voltage higher than a predetermined DC voltage ($V_{out}$) converted through a voltage converter 2, is previously stored in the second setting unit 8. In other words, in the present embodiment, the second reference voltage $V_R$ is previously set in the determination unit 5. The t1 to t2 and t6 of FIG. 11 correspond to the t1 to t2 and t6 of FIG. 9.

The second reference voltage $V_R$ is set at the fixed voltage higher than the predetermined DC voltage ($V_{out}$) in consideration of an upper limit value of variation in forward voltage of the LED devices 21, the highest of the forward voltages of the plurality of different LED devices 21, and a total forward voltage of one or more (N: N≥2 in the present embodiment) LED devices 21.

The second setting unit 8 is configured to supply a fourth voltage signal corresponding to the second reference voltage $V_R$ to the non-inverting input terminal of the comparator CP2.

Figure 12:
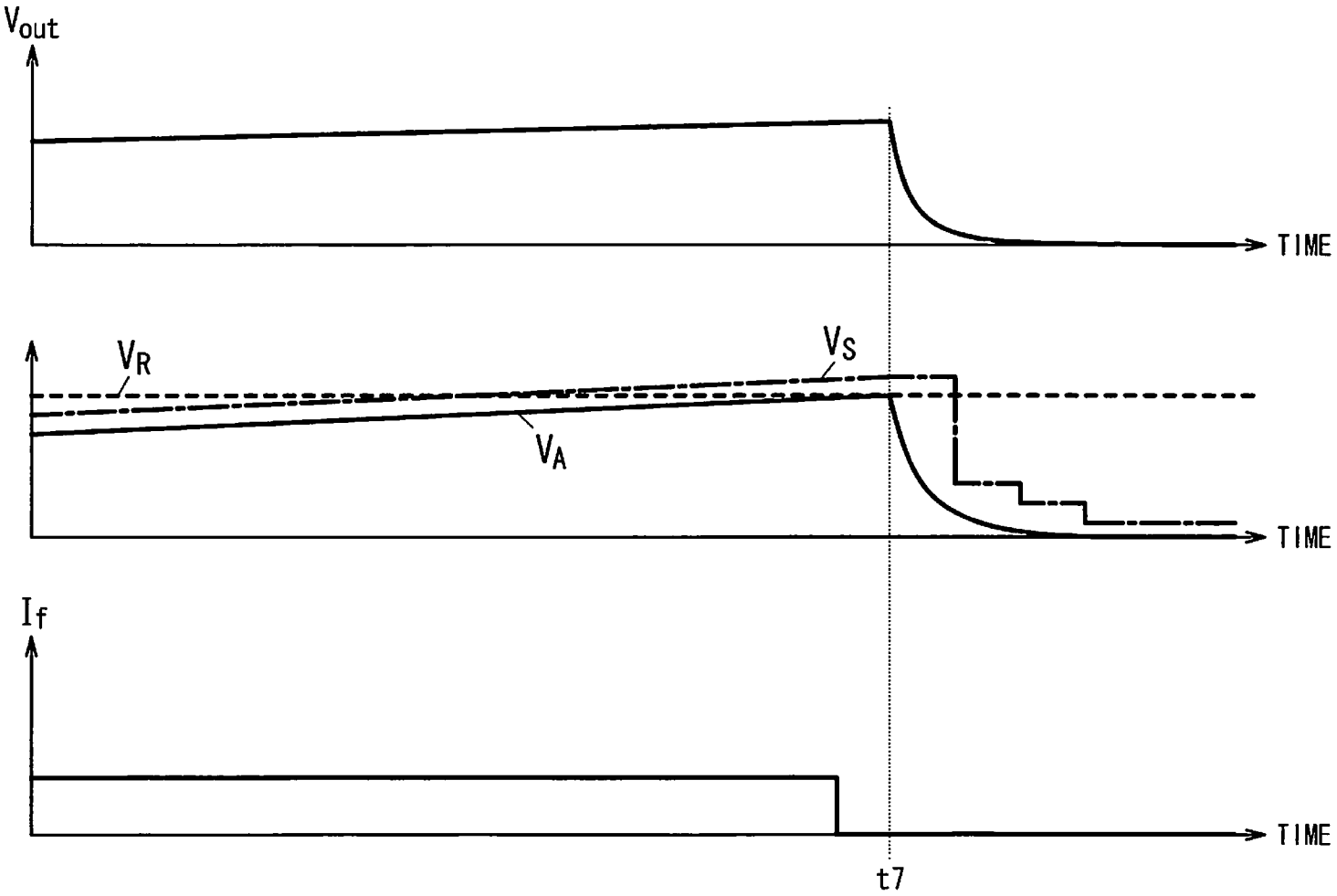
FIG. 12 is an explanatory diagram showing another example of output voltage, detection voltage, first reference voltage, second reference voltage, and output current in the lighting device of embodiment 4.

In the present embodiment, when a malfunction occurs in an LED device 21 due to a failure or aging degradation of the LED device 21, the output voltage $V_{out}$ of the lighting device 10 gradually increases as shown in FIG. 12. In the present embodiment, when the output voltage $V_{out}$ of the lighting device 10 gradually increases, each of the detection voltage $V_A$ by the detector 4 and the first reference voltage $V_S$ increases gradually.

The comparator CP2 is configured to change the output thereof from the high level to the low level when the detection voltage $V_A$ by the detector 4 input to the inverting input terminal is the second reference voltage $V_R$ or higher (time t7 in FIG. 12). Thus, the determination unit 5 can determine whether the detection voltage $V_A$ by the detector 4 is the second reference voltage $V_R$ or higher.

The AND circuit 9 is configured to change the output thereof from the high level to the low level when the output of the comparator CP2 changes from the high level to the low level.

The control circuit 14 is configured to keep the OFF state of the switching device Q1 through the driving circuit 6 when the output of the AND circuit 9 changes from the high level to the low level. Thus, when the detection voltage $V_A$ by the detector 4 is determined to be the second reference voltage $V_R$ or higher through the determination unit 5, the controller 13 can stop the operation of the voltage converter 2.

In the above-mentioned present embodiment, the second reference voltage $V_R$, which is the fixed voltage higher than the detection voltage $V_A$ obtained from the predetermined DC voltage ($V_{out}$) converted through the voltage converter 2, is previously set in the determination unit 5. The second reference voltage $V_R$ is previously set for normal LED devices 21, for example. The determination unit 5 is configured to determine whether the detection voltage $V_A$ by the detector 4 is the second reference voltage $V_R$ or higher. The controller 13 is configured to stop the operation of the voltage converter 2 when the detection voltage $V_A$ by the detector 4 is determined to be the second reference voltage $V_R$ or higher through the determination unit 5. Thus, in the present embodiment, for example when a malfunction occurs in an LED device 21 due to a failure or aging degradation of the LED device 21, the operation of the voltage converter 2 can be stopped.

The lighting device 10 of the present embodiment may be used for the luminaire 30 as described in embodiment 1.

Embodiment 5

Figure 13:
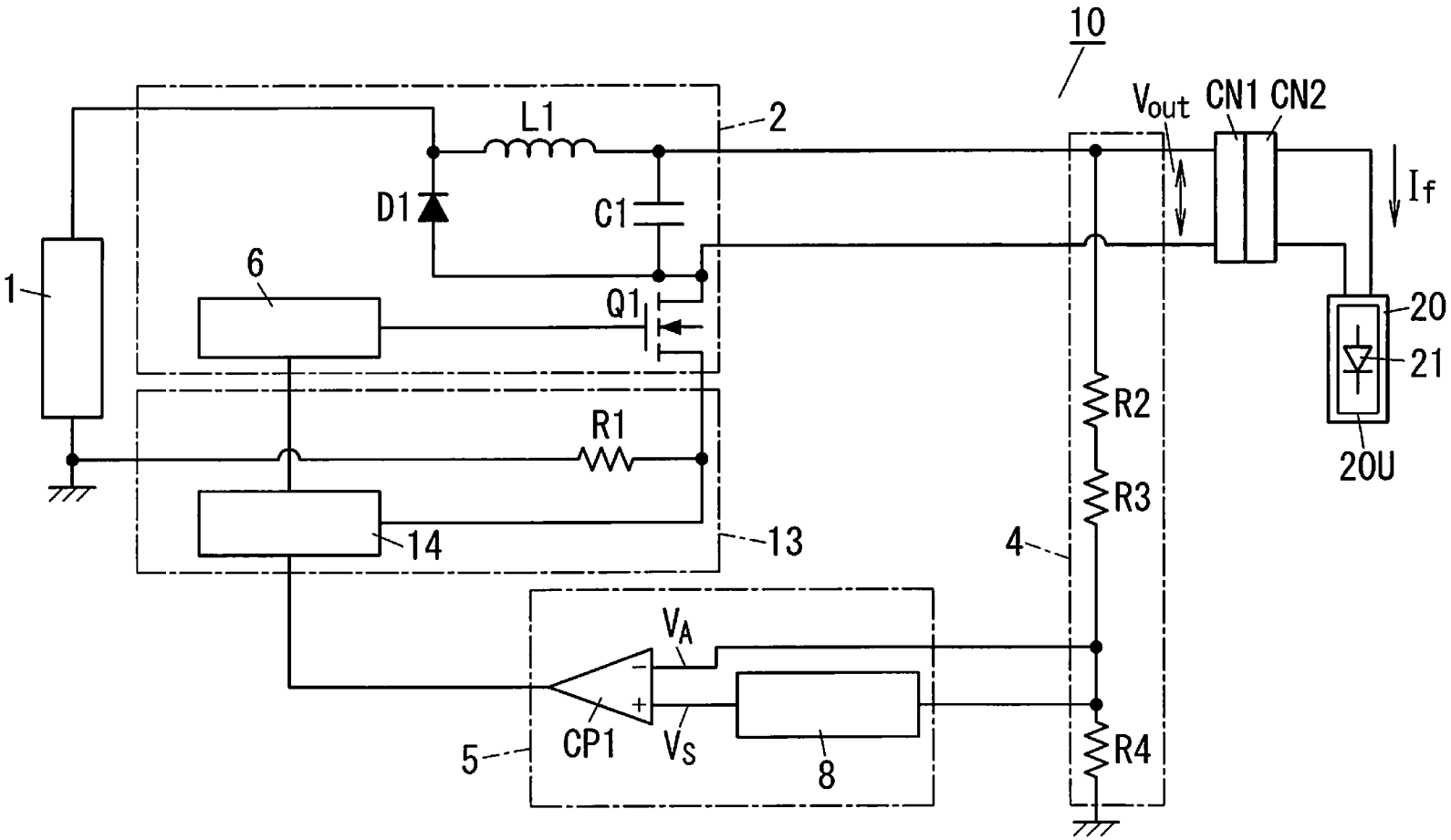
FIG. 13 is a schematic circuit diagram of a lighting device of embodiment 5.

The basic configuration of a lighting device 10 of embodiment 5 is similar to that of embodiment 3. As shown in FIG. 13, embodiment 5 differs from embodiment 3 in that a switching device Q1 is disposed on a low potential side of a lighting device 10. In embodiment 5, components similar to those in embodiment 3 are denoted with the same reference signs, and the descriptions of those components are omitted appropriately.

A first end of an inductor L1 is connected to a high potential side of a DC power supply 1. A second end of the inductor L1 is connected to a high potential side of a capacitor C1. A low potential side of the capacitor C1 is connected to an anode side of a diode D1. A cathode side of the diode D1 is connected to the first end of the inductor L1.

A drain terminal of the switching device Q1 is connected to the low potential side of the capacitor C1. A gate terminal of the switching device Q1 is connected to a driving circuit 6. A source terminal of the switching device Q1 is connected, via a resistor R1, to a low potential side of the DC power supply 1.

A control circuit 14 is connected to a junction between the source terminal of the switching device Q1 and the resistor R1. The control circuit 14 is connected to the driving circuit 6. The control circuit 14 is also connected to an output terminal of a comparator CP1.

Also in the present embodiment, even if the electrical connection between the light source 20 and the lighting device 10 is released in the lit state of the light source 20, an increase in output voltage $V_{out}$ of the lighting device 10 can be suppressed comparing with the lighting device 11 of the comparative example. Therefore, also in the present embodiment, even if the light source 20 is electrically connected to the lighting device 10 again after an output voltage $V_{out}$ of the lighting device 10 increases, an overcurrent can be inhibited from flowing through the light source 20 comparing with the lighting device 11 of the comparative example.

The lighting device 10 of the present embodiment may be used for the luminaire 30 as described in embodiment 1. Switching device Q1 of each of embodiments 1, 2 and 4 may be disposed on a low potential side of a lighting device 10 similarly to the switching device Q1 of the present embodiment.

The invention claimed is:

1. A lighting device, configured to be detachably attached with a light source comprising an LED device as a lighting object, the lighting device comprising:

a voltage converter configured to convert a DC voltage supplied from a DC power supply into a predetermined DC voltage;

a detector configured to detect the predetermined DC voltage applied across the light source to generate a detection voltage;

a controller configured to control the voltage converter so that a current flowing through the light source is constant; and a determination unit configured to determine whether the detection voltage by the detector is a preset first reference voltage or higher, wherein the controller is configured to stop an operation of the voltage converter when the detection voltage by the detector is determined to be the preset first reference voltage or higher through the determination unit, the preset first reference voltage is set higher by a specified voltage than the detection voltage by the detector, the specified voltage being set at a voltage of 1% to 10% of the detection voltage by the detector, and the preset first reference voltage is set to vary more slowly than the detection voltage, a time constant of the determination unit being set larger than those of the voltage converter and controller.

2. The lighting device of claim 1, wherein the light source includes a plurality of different LED devices having different rated voltages.

3. The lighting device of claim 1, wherein the light source includes at least two LED units, each of the LED units including a plurality of LED devices connected in series or parallel, and the at least two LED units are connected in series.

4. The lighting device of to claim 2, wherein the light source includes at least two LED units, each of the LED units including a plurality of LED devices connected in series or parallel, and the at least two LED units are connected in series.

5. The lighting device of claim 1, wherein the preset first reference voltage is set to be higher than the detection voltage in at least a specified period after a time when the predetermined DC voltage is output from the voltage converter, the detection voltage being obtained from the predetermined DC voltage.

6. The lighting device of claim 2, wherein the preset first reference voltage is set to be higher than the detection voltage in at least a specified period after a time when the predetermined DC voltage is output from the voltage converter, the detection voltage being obtained from the predetermined DC voltage.

7. The lighting device of claim 3, wherein the preset first reference voltage is set to be higher than the detection voltage in at least a specified period after a time when the predetermined DC voltage is output from the voltage converter, the detection voltage being obtained from the predetermined DC voltage.

8. The lighting device of claim 4, wherein the preset first reference voltage is set to be higher than the detection voltage in at least a specified period after a time when the predetermined DC voltage is output from the voltage converter, the detection voltage being obtained from the predetermined DC voltage.

9. A lighting device, configured to be detachably attached with a light source comprising an LED device as a lighting object, the lighting device comprising:

a voltage converter configured to convert a DC voltage supplied from a DC power supply into a predetermined DC voltage;

a detector configured to detect the predetermined DC voltage applied across the light source to generate a detection voltage;

a controller configured to control the voltage converter so that a current flowing through the light source is constant; and a determination unit configured to determine whether the detection voltage by the detector is a preset first reference voltage or higher, wherein the first reference voltage is set higher by a specified voltage than the detection voltage by the detector, and is set to vary more slowly than the detection voltage, the controller is configured to stop an operation of the voltage converter when the detection voltage by the detector is determined to be the first reference voltage or higher through the determination unit, a second reference voltage is previously set in the determination unit, the second reference voltage being a fixed voltage higher than the detection voltage obtained from the predetermined DC voltage, the determination unit is configured to determine whether the detection voltage by the detector is the second reference voltage or higher, and the controller is configured to stop an operation of the voltage converter when the detection voltage by the detector is determined to be the second reference voltage or higher through the determination unit.

10. The lighting device of claim 2, wherein a second reference voltage is previously set in the determination unit, the second reference voltage being a fixed voltage higher than the detection voltage obtained from the predetermined DC voltage, the determination unit is configured to determine whether the detection voltage by the detector is the second reference voltage or higher, and the controller is configured to stop an operation of the voltage converter when the detection voltage by the detector is determined to be the second reference voltage or higher through the determination unit.

11. The lighting device of claim 3, wherein a second reference voltage is previously set in the determination unit, the second reference voltage being a fixed voltage higher than the detection voltage obtained from the predetermined DC voltage, the determination unit is configured to determine whether the detection voltage by the detector is the second reference voltage or higher, and the controller is configured to stop an operation of the voltage converter when the detection voltage by the detector is determined to be the second reference voltage or higher through the determination unit.

12. The lighting device of claim 4, wherein a second reference voltage is previously set in the determination unit, the second reference voltage being a fixed voltage higher than the detection voltage obtained from the predetermined DC voltage, the determination unit is configured to determine whether the detection voltage by the detector is the second reference voltage or higher, and the controller is configured to stop an operation of the voltage converter when the detection voltage by the detector is determined to be the second reference voltage or higher through the determination unit.

13. The lighting device of claim 5, wherein a second reference voltage is previously set in the determination unit, the second reference voltage being a fixed voltage higher than the detection voltage obtained from the predetermined DC voltage, the determination unit is configured to determine whether the detection voltage by the detector is the second reference voltage or higher, and the controller is configured to stop an operation of the voltage converter when the detection voltage by the detector is determined to be the second reference voltage or higher through the determination unit.

14. The lighting device of claim 6, wherein a second reference voltage is previously set in the determination unit, the second reference voltage being a fixed voltage higher than the detection voltage obtained from the predetermined DC voltage, the determination unit is configured to determine whether the detection voltage by the detector is the second reference voltage or higher, and the controller is configured to stop an operation of the voltage converter when the detection voltage by the detector is determined to be the second reference voltage or higher through the determination unit.

15. The lighting device of claim 7, wherein a second reference voltage is previously set in the determination unit, the second reference voltage being a fixed voltage higher than the detection voltage obtained from the predetermined DC voltage, the determination unit is configured to determine whether the detection voltage by the detector is the second reference voltage or higher, and the controller is configured to stop an operation of the voltage converter when the detection voltage by the detector is determined to be the second reference voltage or higher through the determination unit.

16. A luminaire, comprising:

a light source comprising an LED device; and a lighting device configured to be detachably attached with the light source, wherein the lighting device comprises:

a voltage converter configured to convert a DC voltage supplied from a DC power supply into a predetermined DC voltage;

a detector configured to detect the predetermined DC voltage applied across the light source to generate a detection voltage;

a controller configured to control the voltage converter so that a current flowing through the light source is constant; and a determination unit configured to determine whether the detection voltage by the detector is a preset first reference voltage or higher, wherein the controller is configured to stop an operation of the voltage converter when the detection voltage by the detector is determined to be the preset first reference voltage or higher through the determination unit, the preset first reference voltage is set higher by a specified voltage than the detection voltage by the detector, the specified voltage being set at a voltage of 1% to 10% of the detection voltage by the detector, and the preset first reference voltage is set to vary more slowly than the detection voltage, a time constant of the determination unit being set larger than those of the voltage converter and controller.

17. The luminaire of claim 16, wherein the light source includes a plurality of different LED devices having different rated voltages.

18. The luminaire of claim 16, wherein the light source includes at least two LED units, each of the LED units including a plurality of LED devices connected in series or parallel, and the at least two LED units are connected in series.

19. The luminaire of claim 16, wherein the preset first reference voltage is set to be higher than the detection voltage in at least a specified period after a time when the predetermined DC voltage is output from the voltage converter, the detection voltage being obtained from the predetermined DC voltage.

20. A luminaire comprising:

a light source comprising an LED device; and a lighting device configured to be detachably attached with the light source, wherein the lighting device comprises:

a voltage converter configured to convert a DC voltage supplied from a DC power supply into a predetermined DC voltage;

a detector configured to detect the predetermined DC voltage applied across the light source to generate a detection voltage;

a controller configured to control the voltage converter so that a current flowing through the light source is constant; and a determination unit configured to determine whether the detection voltage by the detector is a preset first reference voltage or higher, wherein the first reference voltage is set higher by a specified voltage than the detection voltage by the detector, and is set to vary more slowly than the detection voltage, the controller is configured to stop an operation of the voltage converter when the detection voltage by the detector is determined to be the first reference voltage or higher through the determination unit, a second reference voltage is previously set in the determination unit, the second reference voltage being a fixed voltage higher than the detection voltage obtained from the predetermined DC voltage, the determination unit is configured to determine whether the detection voltage by the detector is the second reference voltage or higher, and the controller is configured to stop an operation of the voltage converter when the detection voltage by the detector is determined to be the second reference voltage or higher through the determination unit.

* * * * *